US007077357B2

(12) United States Patent
Taki

(10) Patent No.: US 7,077,357 B2
(45) Date of Patent: Jul. 18, 2006

(54) BLOCK SET FOR ASSEMBLING A SOLID CREATION AND APPARATUS FOR FABRICATING BLOCK FOR ASSEMBLING SOLID CREATION

(75) Inventor: Yoshihiro Taki, Kyoto (JP)

(73) Assignee: Koto Co., Ltd., Kyoto (JP)

( * ) Notice: Subject to any disclaimer, the term of this patent is extended or adjusted under 35 U.S.C. 154(b) by 62 days.

(21) Appl. No.: 11/006,712

(22) Filed: Dec. 8, 2004

(65) Prior Publication Data

US 2005/0102966 A1 May 19, 2005

Related U.S. Application Data

(62) Division of application No. 10/409,592, filed on Apr. 9, 2003.

(30) Foreign Application Priority Data

Apr. 17, 2002 (JP) ..... 2002-115410
Oct. 17, 2002 (JP) ..... 2002-303391

(51) Int. Cl.
*B65H 19/28* (2006.01)

(52) U.S. Cl. ..... 242/586.2; 242/586; 242/587; 242/587.1; 52/750

(58) Field of Classification Search ..... 52/503, 52/749.13, 750; 242/586, 586.2, 587, 587.1, 242/587.2, 587.3
See application file for complete search history.

(56) References Cited

FOREIGN PATENT DOCUMENTS

| | | |
|---|---|---|
| JP | 08-168577 | 7/1996 |
| JP | 10-108985 | 4/1998 |
| JP | 11-217138 | 8/1999 |

*Primary Examiner*—Carl D. Friedman
*Assistant Examiner*—Basil Katcheves
(74) *Attorney, Agent, or Firm*—Snider & Associates; Ronald R. Snider

(57) ABSTRACT

A block set for assembling solid creations uses at least two types of cylindrical blocks. The cylindrical blocks are a thin cylindrical block and a thick cylindrical block. The thick cylindrical block may include a hole on a side face thereof for receiving the thin cylindrical block. A fabricating apparatus for fabricating the thin and thick cylindrical blocks has at least two types of rollers for rolling up paper, and a paper thickness notifying apparatus for notifying the user of the diameter of the cylindrical paper roll on a cylindrical paper roll up core.

7 Claims, 32 Drawing Sheets

(a)

(b)

(c)

BLOCK SET FOR ASSEMBLING A SOLID CREATION AND APPARATUS FOR FABRICATING BLOCK FOR ASSEMBLING SOLID CREATION

RELATED APPLICATIONS

This application claims the priority of Japanese patent application No. 2002-303391 filed on Apr. 17, 2002, and Japanese patent application No. 2002-303391 filed on Oct. 17, 2002, which are incorporated herein by reference. Further, this application is a divisional of U.S. patent application Ser. No. 10/409,592 filed on Apr. 9, 2003.

BACKGROUND OF THE INVENTION

1. Field of the Invention

The present invention relates to a solid creation assembly block set for assembling solid creation which uses at least two different blocks that are thin cylindrical block of a desired length having cylindrically rolled paper and a thick cylindrical block having cylindrically rolled paper with an internal diameter capable of mounting the thin cylindrical block. Assembling of a solid creation is by mounting the thin cylindrical block in a center cavity portion of the thick cylindrical block or into a hole which opens on a side face of the thick cylindrical block. Further, the present invention relates to a solid creation assembly block fabricating apparatus for fabricating two types of blocks.

2. Description of the Related Art

As well known, there has been generally used: an assembly toy (for example, refer to Japanese Patent Application Laid-open No. 8-168577) for connecting plastic blocks, thereby permitting assembly of solid creations an educational topic for fostering children's creativity or a toy consisting of blocks in which a predetermined solid creation is divided into parts, a top (for example, refer to Japanese Patent Application Laid-open No. 10-108985) a solid creation can be assembled by incorporating electric parts or the like into these blocks. The solid creation is composed of the blocks.

No prior art patent document could be found which relates to an apparatus for fabricating blocks for assembling solid creations according to the present invention. Japanese Patent Application Laid-open No. 11-217138 shows a roll paper winder was in relation to a paper rolling mechanism of the apparatus.

However, a solid creation that can be assembled by the conventional assembly toy is limited to a solid creation in a range that can be assembled by blocks included in the toy. Therefore, there has been a problem that realizing a solid creation freely created by children is limited. In addition, there is a need to prepare assembly toys for many children when the conventional assembly toy is used as an educational toy for teaching material for fostering children's creativity. Higher educational cost is unavoidable because such a toy is more expensive with its higher precision or higher class. Further, in the conventional assembly toy which parents only give children by purchasing it, there has been tendency of decrease in the conversation between parents and children.

Therefore, the inventor conducted research and experiments by defining a technical object of providing a solid creation assembly block set capable of realizing a solid creation freely created by children and a solid creation assembly block fabricating apparatus capable of obtaining the block set. As a result, the Inventor achieved the above described technical object by obtaining the following noticeable finding. That is, instead of using or purchasing commercially available parts for assembly of a solid creation, parts capable of assembling a solid creation by using daily delivered newspaper, fold out handbills, package paper, used copy paper and the like can be fabricated. Thus, such parts can be easily organized at an education site, which leads to recycling of unnecessary papers and contributes to energy saving. Moreover, by fabricating parts, each of which constitutes a solid creation created by children, parents and children can play assembly altogether, and opportunities of conversions among them increase.

SUMMARY OF THE INVENTION

The present invention has been made in order to solve the above described technical problems.

That is, according to a first aspect of the present invention, there is provided a block set for assembly of a solid creation comprising at least two types of blocks, that is:

- a thin cylindrical block of a desired length formed by cylindrically rolling paper; and
- a thick cylindrical block of a desired length formed by cylindrically rolling paper having an internal diameter capable of mounting the thin cylindrical block, wherein a solid creation can be assembled by mounting the thin cylindrical block into a cavity portion of the thick cylindrical block.

According to a second aspect of the present invention, there is provided a hole opening on a side face of the thick cylindrical block for-receiving the, thin cylindrical block.

According to a third aspect of the present invention, there is provided a block set for assembly of a solid creation comprising at least two types of blocks, that is:

- a thin cylindrical block of a desired length formed by cylindrically rolling paper; and
- a thick cylindrical block of a desired length formed by cylindrically rolling paper, wherein the thick cylindrical block has an internal diameter capable of inserting the thin cylindrical block.

According to a fourth aspect of the present invention, there is provided a hole of an internal diameter substantially close to an external diameter of the thin cylindrical block opens on a side face thereof.

According to a fifth aspect of the present invention, there is provided a solid creation assembly block fabricating apparatus for fabricating two types of blocks in a block set for assembly of a solid creation by mounting a thin cylindrical block into a cavity portion of a thick cylindrical block or an incorporating hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

a thin paper roll-up core shaft for rolling paper by rotatably bridging the paper in the shaft holes, thereby fabricating the thin cylindrical block; and a thick paper roll-up core shaft of an external diameter which is greater than an external diameter of the incorporating paper roll-up core for rolling paper by rotatably bridging the paper in the shaft holes, thereby fabricating the thin cylindrical block.

According to a sixth aspect of the present invention, there is provided a solid creation assembly block fabricating apparatus for fabricating two types of blocks in a block set for assembly of a solid creation by mounting a thin cylindrical block into a cavity portion of a thick cylindrical block or an incorporating hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

a thin paper roll-up core shaft for rolling paper by rotatably bridging the paper in the shaft holes, thereby fabricating the thin cylindrical block;

a thick paper roll-up core shaft of an external diameter which is greater than an external diameter of the incorporating paper roll-up core for rolling paper by rotatably bridging the paper in the shaft holes, thereby fabricating the thin cylindrical block; and paper thickness notifying means for notifying that a cylinder diameter of paper rolled on the incorporating paper roll-up core shaft has been rolled on an external diameter engaged in the cavity portion of the thick cylindrical block.

According to a seventh aspect of the present invention, there is provided a solid creation assembly block fabricating apparatus for fabricating two types of blocks in a block set for assembly of a solid creation by mounting a thin cylindrical block into a cavity portion of a thick cylindrical block or an incorporating hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

a thin paper roll-up core shaft for rolling paper by rotatably bridging the paper in the shaft holes, thereby fabricating the thin cylindrical block;

an assembling paper roll-up core shaft of an external diameter which is greater than an external diameter of the paper roll-up core for rolling paper by rotatably bridging the paper in the shaft holes, thereby fabricating the thin cylindrical block; and paper thickness notifying means for notifying that a cylinder diameter of paper rolled on the incorporating paper roll-up core shaft has been rolled on an external diameter engaged in the cavity portion of the thick cylindrical block, wherein, on said each paper roll-up core shaft, a slit for inserting a distal end side of the paper running up to a distal end of the paper roll-up core shaft is provided in parallel to an axial core of the paper roll-up core shaft; the slit is formed in a longitudinal cross section arc shape inscribed in the paper roll-up core shaft toward the inside of the paper roll-up core shaft from a side face of the paper roll-up core shaft; and a guide plate for guiding a distal end side of the paper to a position along the slit of the paper roll-up core shaft when the paper roll-up core shaft is provided in the shaft hole is transversely provided on the support plate.

According to an eighth aspect of the present invention, there is provided a solid creation assembling block fabricating apparatus according to the fifth aspect of the invention, wherein the paper thickness notifying means is a paper thickness display portion which indicates paper thickness dimensions of a paper cylinder rolled on an external diameter engaged in the cavity portion of the thick cylindrical block.

According to a ninth aspect of the present invention, there is provided a solid creation assembly block fabricating apparatus according to the fifth aspect of the invention, wherein the paper thickness notifying means is a paper thickness recognizing arm portion having an arc shaped engagement recess portion maintained in a backlash state by being transversely engaged in the incorporating paper roll-up core shaft rotatably provided in the shaft hole; the paper cylinder rolled on the incorporating paper roll-up core shaft is engaged with the arc shaped engagement recess portion in an intimate contact state so that rolling on the incorporating paper roll-up core shaft is inhibited, whereby the cylinder diameter of paper rolled on the incorporating roll-up core shaft is rolled on the external diameter engaged in the cavity portion of the thick cylindrical block.

According to a tenth aspect of the present invention, there is provided a solid creation assembly block fabricating apparatus for fabricating two types of blocks in a block set for assembly of a solid creation by mounting a thin cylindrical block into a cavity portion of a thick cylindrical block or into a hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising: a set of support plates erected opposite to each other and having shaft holes opened at relative positions;

an incorporating paper roll-up core shaft for rolling paper by rotatably bridging the paper in the shaft holes, thereby fabricating the cylindrical block;

an assembling paper roll-up core shaft of an external diameter which is greater than an external diameter of the incorporating paper roll-up core for rolling paper by rotatably bridging the paper in the shaft holes, thereby fabricating the thin cylindrical block;

a set of turnable compression roller abutted against the paper roll-up core shaft provided in the shaft hole by biasing the rollers from both sides; and a paper thickness display portion for indicating paper thickness dimensions rolled on the external diameter engaged in the cavity portion of the thick cylindrical block together with the compression roller which is spread as paper is rolled on the thick cylindrical block.

According to an eleventh aspect of the present invention, there is provided a solid creation assembly block fabricating apparatus for fabricating two types of blocks in a block set for assembly of a solid creation by mounting a thin cylindrical block into a cavity portion of a thick cylindrical block or into a hole opening on a side face of the thick cylindrical block by using the two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

an incorporating paper roll-up core shaft for rolling paper by rotatably bridging the paper in the shaft holes, thereby fabricating the thin cylindrical block;

an assembling paper roll-up core shaft of an external diameter which is greater than an external diameter of the incorporating paper roll-up core for rolling paper by rotatably bridging the paper in the shaft holes, thereby fabricating the thin cylindrical block;

a set of turnable compression roller abutted against the paper roll-up core shaft provided in the shaft hole by biasing the rollers from both sides; and a paper thickness display portion for indicating paper thickness dimensions rolled on the external diameter engaged in the cavity portion of the thick cylindrical block together with the compression roller spread as paper is rolled on the thick cylindrical block, wherein, on said each paper roll-up core shaft, a slit for inserting a distal end side of the paper running up to a distal end of the paper roll-up core shaft is provided in parallel to the axial core of the-paper roll-up core shaft; the slit is formed in a longitudinally cross section arc shape inscribed in the paper roll-up core shaft toward the paper roll-up core shaft from the side face of the paper roll-up core shaft, and a guide plate for guiding a distal end side of the paper to a position along the slit of the paper roll-up core shaft when the paper roll-up core shaft is provided in the shaft hole is transversely provided on the support plate.

DESCRIPTION OF THE PREFERRED EMBODIMENTS

Hereinafter, preferred embodiments of the present invention will be described with reference to the accompanying drawings.

First Embodiment

Figure 1:
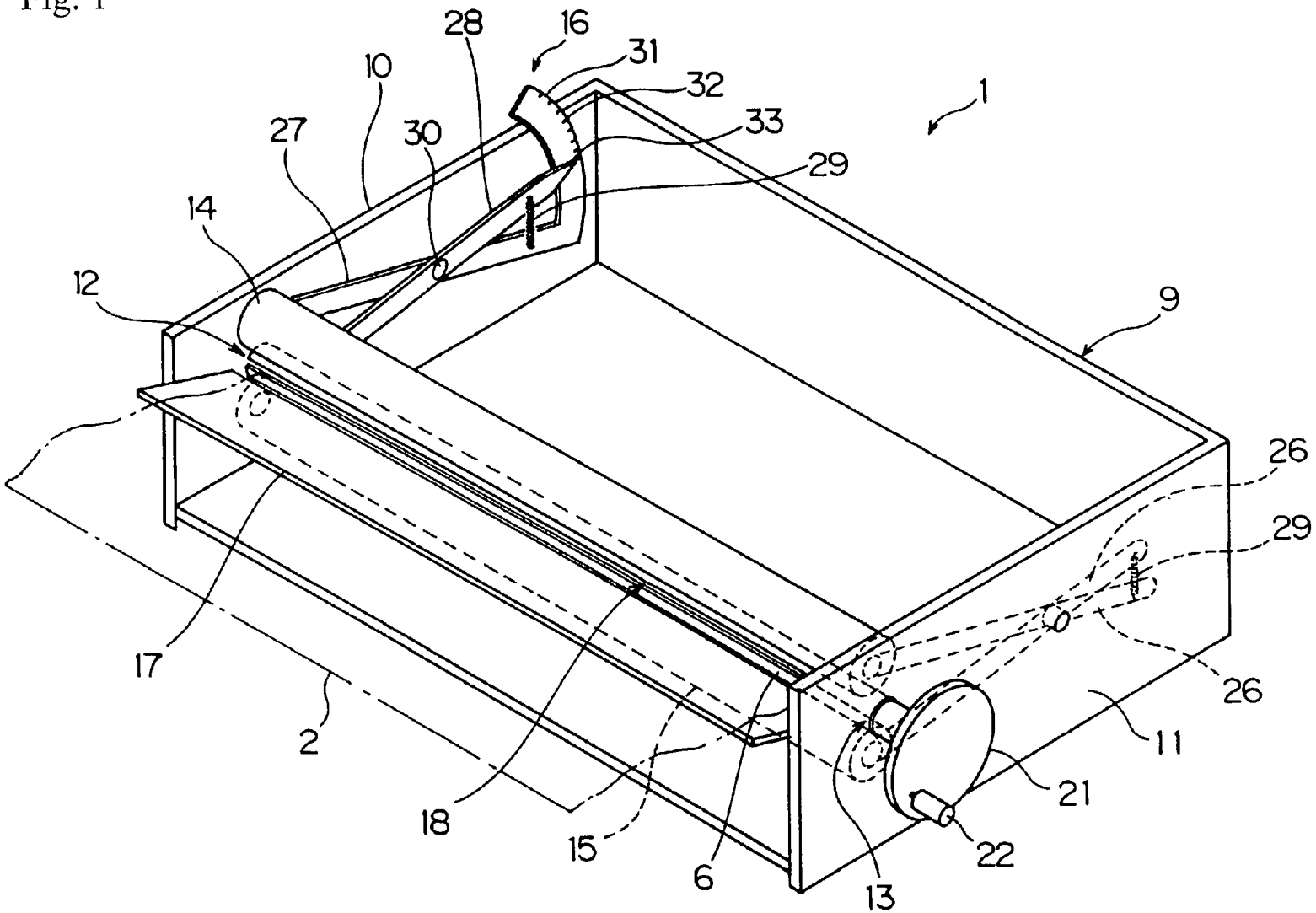
FIG. 1 is a perspective view showing an apparatus for fabricating blocks for assembly of a solid creation according to one embodiment of the present invention.
Figure 2:
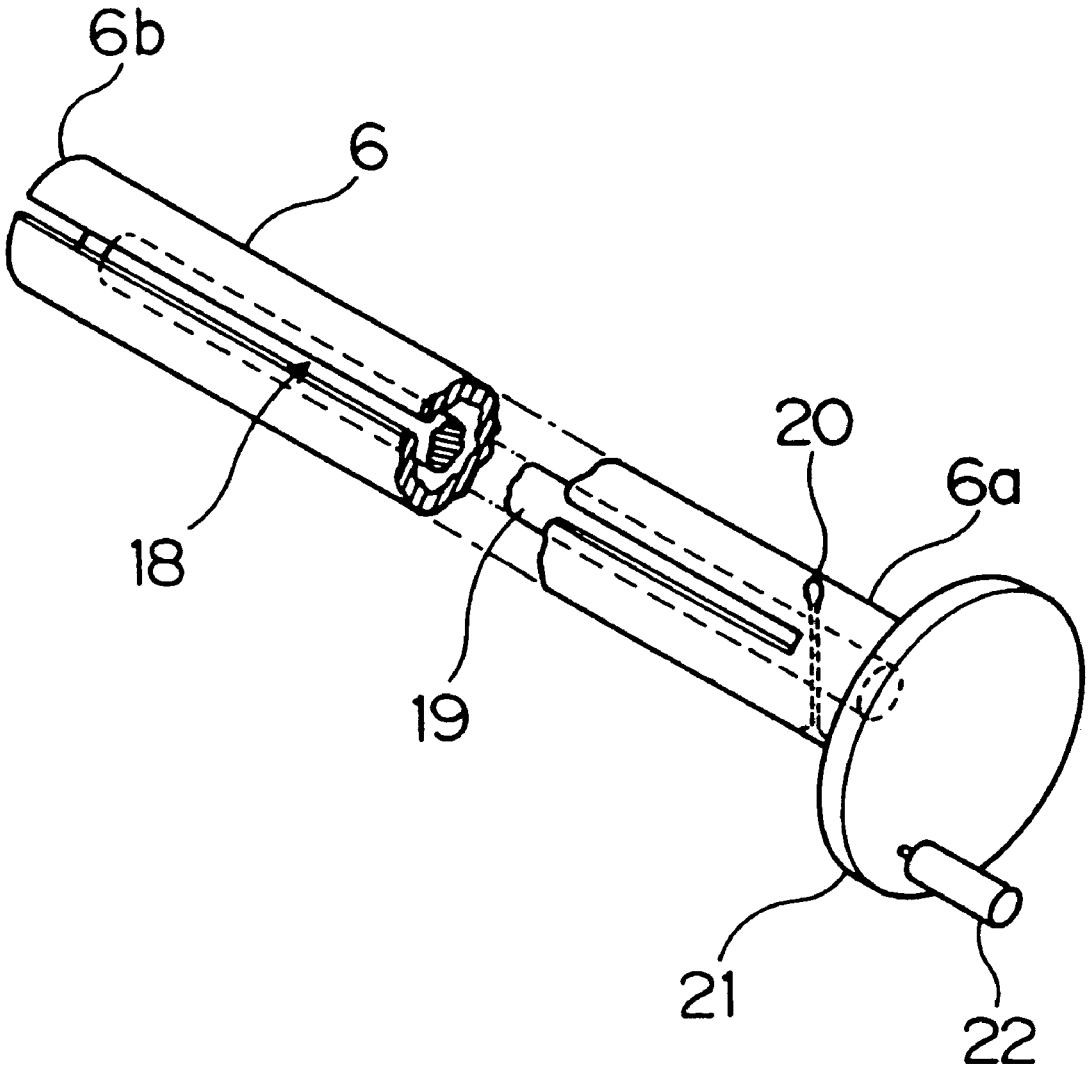
FIG. 2 is a partially omitted perspective view showing a paper roll-up core shaft in the solid creation assembly block fabricating apparatus illustrated in FIG 1.
Figure 3:
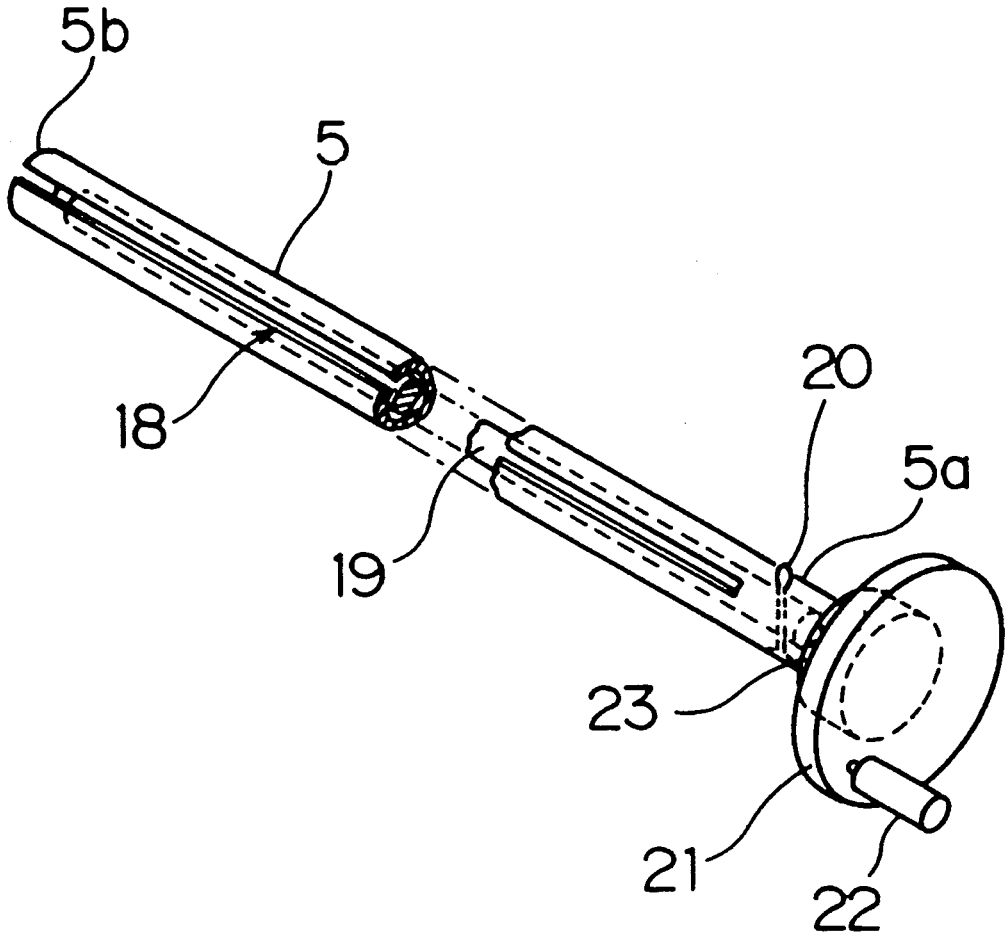
FIG. 3 is a partially omitted perspective view showing a paper roll-up core shaft.
Figure 4:
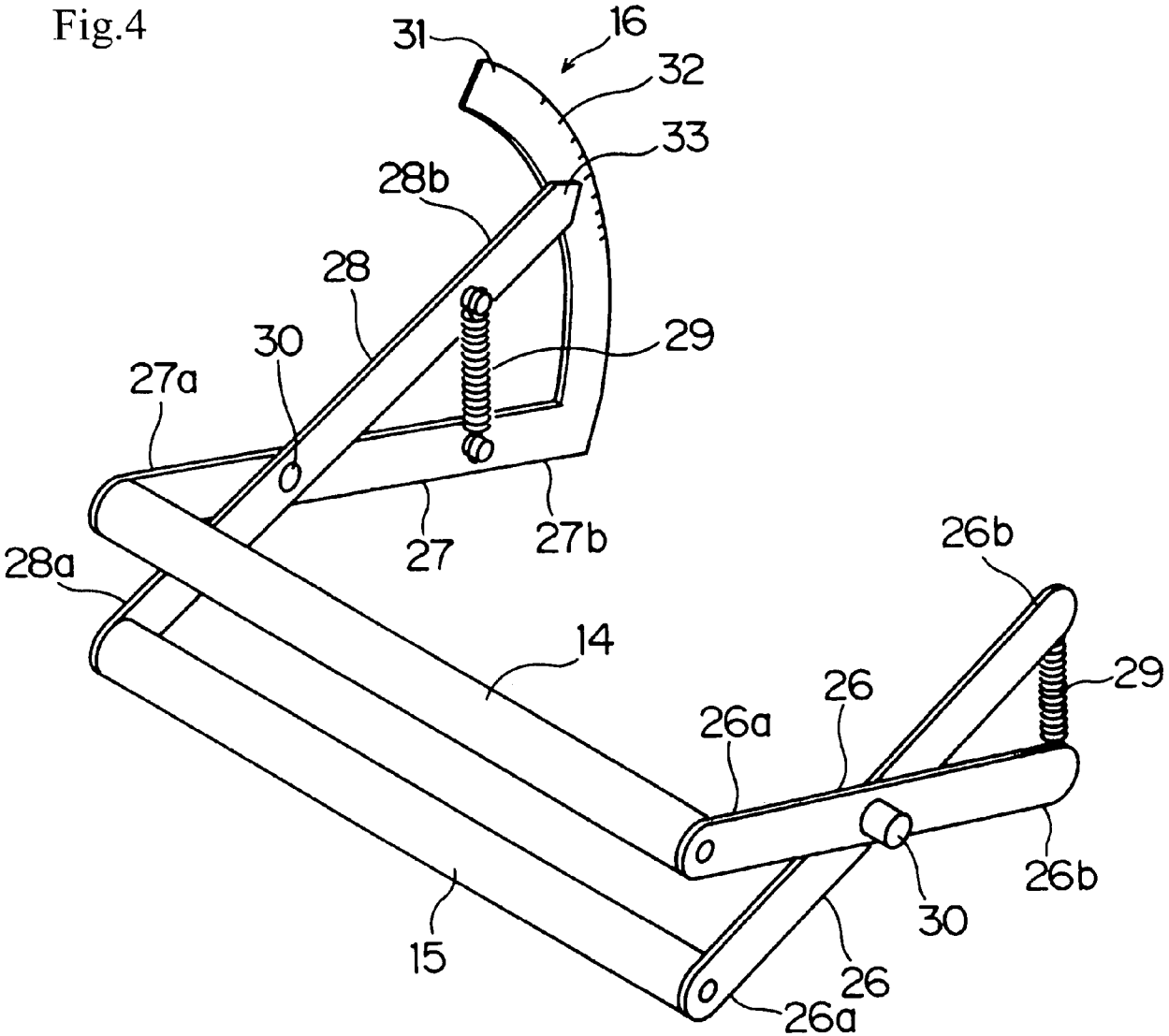
FIG. 4 is a perspective view illustrating a mechanism composed of a set of compression rollers and a paper thickness display portion illustrated in FIG. 1.
Figure 5:
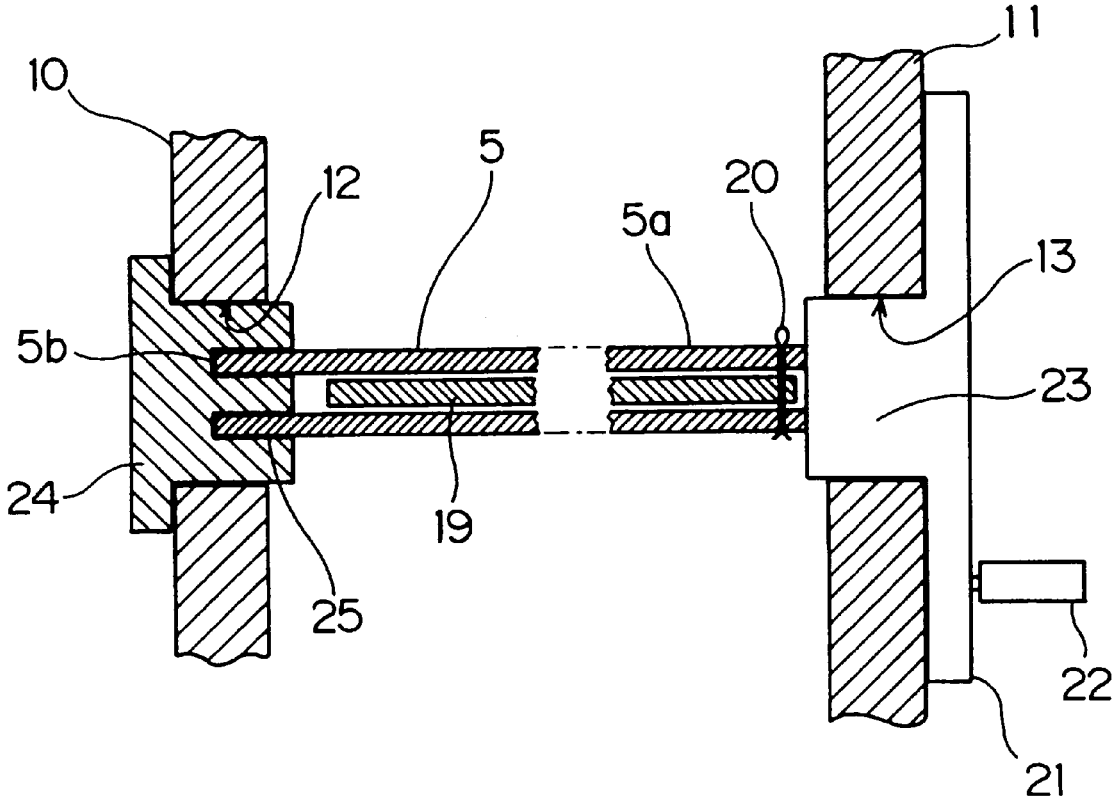
FIG. 5 is a partially omitted front view of a paper roll-up core shaft showing a state in which the paper roll-up core shaft is provided in a shaft hole of a support plate.
Figure 6:
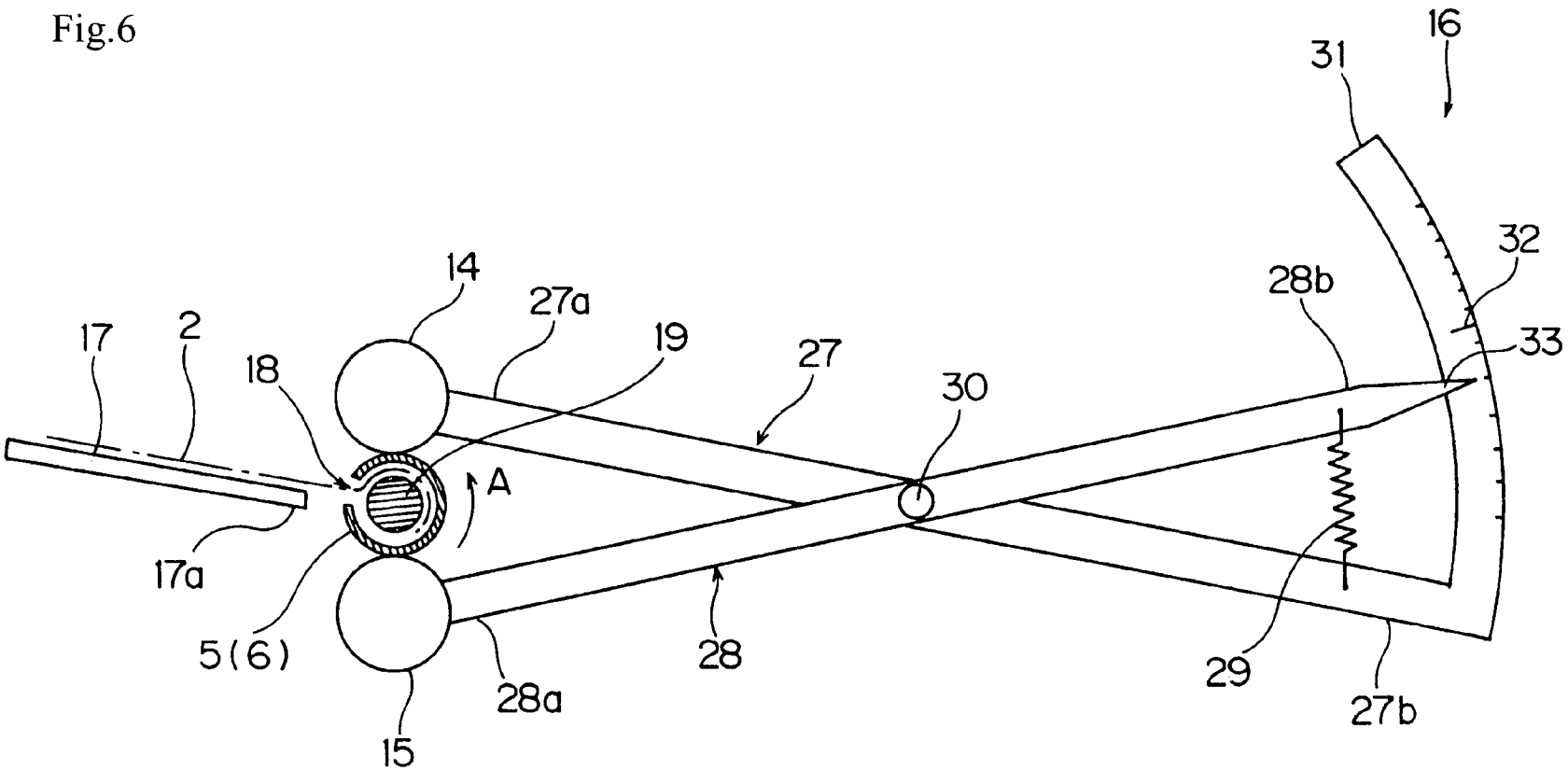
FIG. 6 is a side view illustrating a positional relationship among a paper roll-up core shaft, a compression roller, a paper thickness display portion, and a guide plate.
Figure 7:
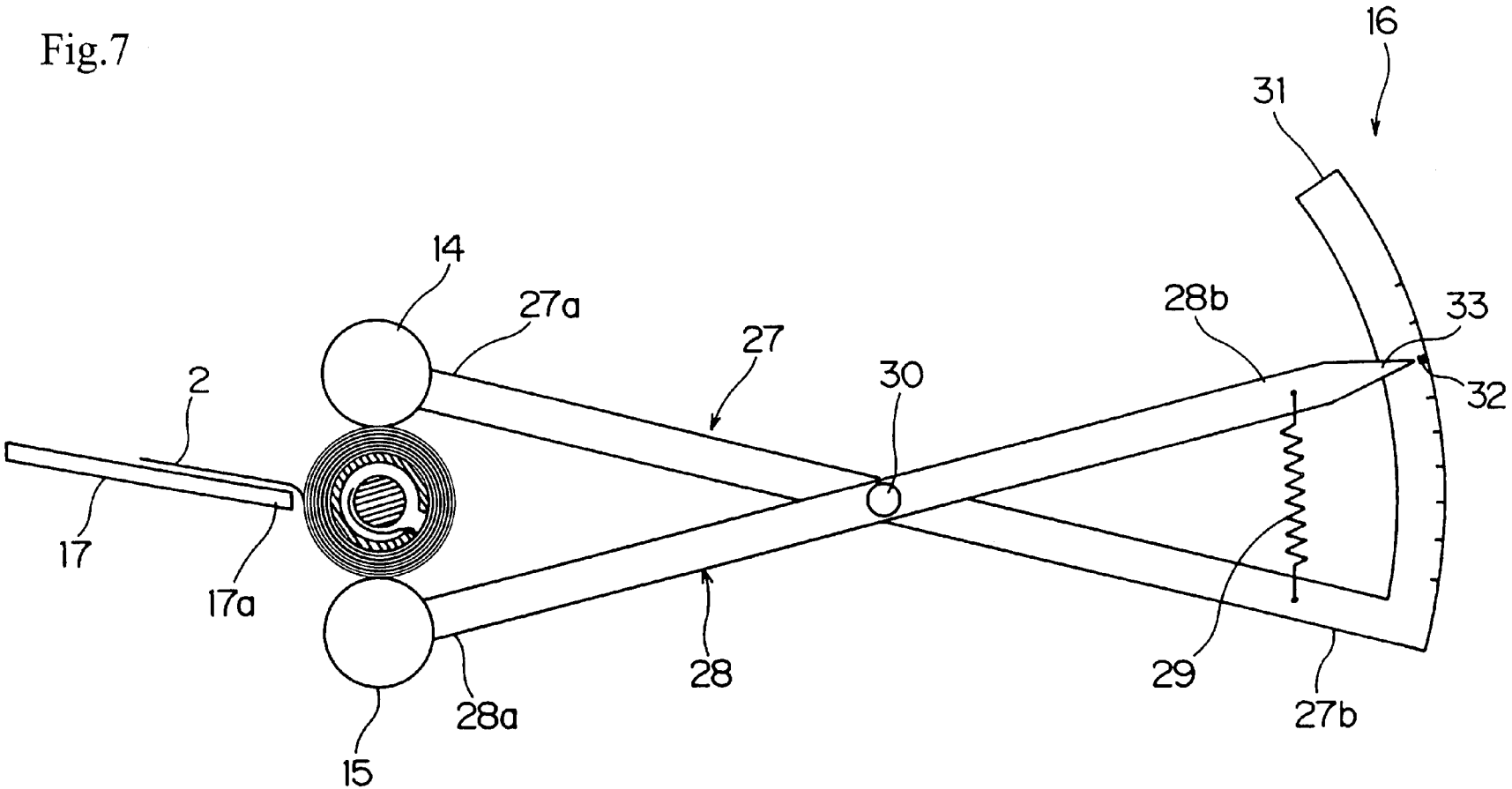
FIG. 7 is a side view illustrating a positional relationship among a paper roll-up core shaft, a compression roller, a paper thickness display portion, and a guide plate.
Figure 8:
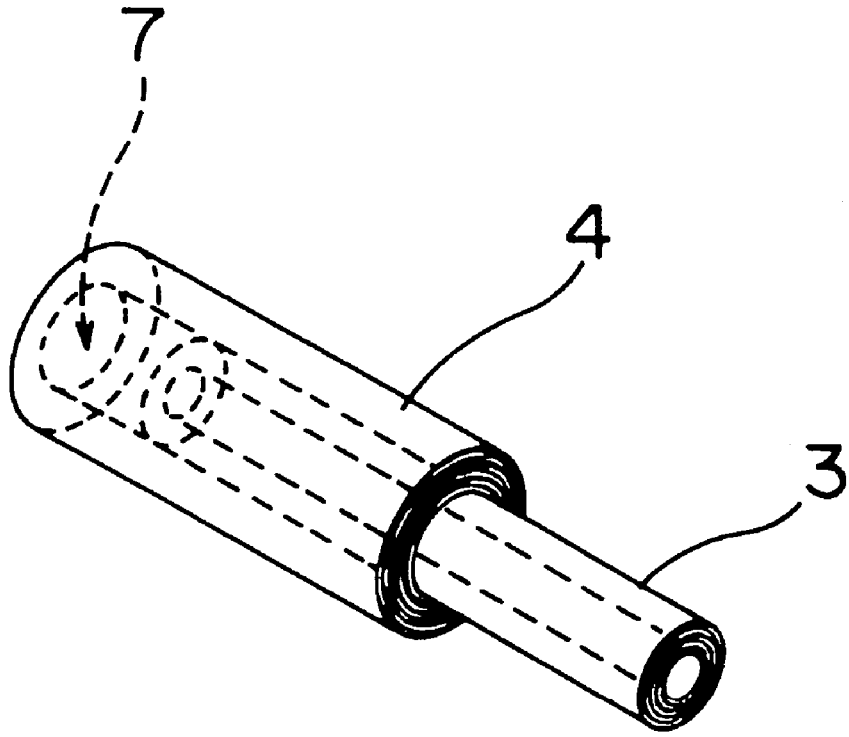
FIG. 8 is a perspective view showing a thin cylindrical block and a thick cylindrical block in a block set for assembly of a solid creation according to one embodiment of the present invention.
Figure 9:
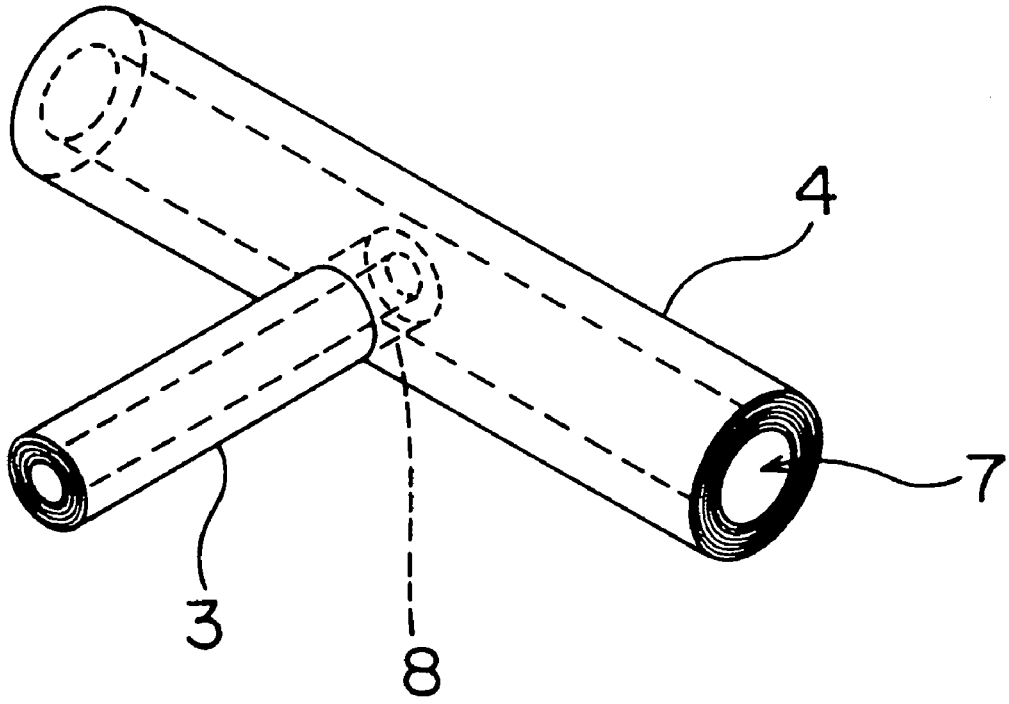
FIG. 9 is a perspective view showing a thin cylindrical block and a thick cylindrical block in a block set for assembly of a solid creation according to one embodiment of the present invention.

FIG. 1 is a perspective view showing an apparatus for fabricating blocks for assembly of a solid creation according to one embodiment of the present invention. FIG. 2 is a partially omitted perspective view showing a thin paper roll-up core shaft in the solid creation assembly block fabricating apparatus illustrated in FIG. 1. FIG. 3 is a partially omitted perspective view showing a thick paper roll-up core shaft. FIG. 4 is a perspective view illustrating a mechanism composed of a set of compression rollers and a paper thickness display portion illustrated in FIG. 1. FIG. 5 is a partially omitted front view of a thick paper roll-up core shaft showing a state in which the thick paper roll-up core shaft is provided in a shaft hole of a support plate, wherein the thick paper roll-up core shaft, support plate, and bearing are illustrated on a longitudinal cross section passing an axial core of the thick paper roll-up core shaft. FIG. 6 and FIG. 7 are side views each illustrating a positional relationship among a paper roll-up core shaft, a compression roller, a paper thickness display portion, and a guide plate. FIG. 8 and FIG. 9 are perspective views each showing a thin cylindrical block and a thick cylindrical block in a block set for assembly of a solid creation according to one embodiment of the present invention. Although the thick paper roll-up core shaft and the thin paper roll-up core shaft are different from each other in size of external diameter, these shafts are identical to each other in shape. Thus, in FIG. 1, there is shown a case in which the thin paper roll-up core shaft is provided, and the paper roll-up core shafts shown in FIG. 6 and FIG. 7 indicate the paper roll-up core shafts of both of the thick paper roll-up core shaft and the thin paper roll-up core shaft. In FIG. 5, a set of compression rollers are omitted.

In these figures, reference numeral 1 denotes a solid creation assembly block fabricating apparatus (hereinafter, simply referred to as a "block fabricating apparatus") for fabricating two types of blocks that are a thin cylindrical block (hereinafter, referred to as a "thin cylindrical block") 3 (refer to FIG. 8 and FIG. 9) of a desired length having cylindrical rolled paper 2 of a desired area such as newspaper, foldout handbill, package paper, or used copy paper (hereinafter, referred to as a "thin cylindrical block"); and an assembling thick cylindrical block (hereinafter, referred to as a "thick cylindrical block") 4 (refer to FIG. 8 and FIG. 9) of a desired length having cylindrically rolled paper 2 having an internal diameter capable of mounting the thin cylindrical block 3. The block fabricating apparatus 1 comprises a cylindrically shaped thin paper roll-up shaft 5 (refer to FIG. 3) for rolling the paper 2, thereby obtaining the thin cylindrical block 3 and a cylindrically shaped thick paper roll-up core shaft 6 (refer to FIG. 1 and FIG. 2) for rolling the paper 2, thereby obtaining the thick cylindrical block 4. In this manner, a solid creation is assembled by mounting the thin cylindrical block 3 in an incorporating hole 8 (refer to FIG. 9) opened at a cavity portion 7 (refer to FIG. 8 and FIG. 9) of the thick cylindrical block 4 or at the side face of the thick cylindrical block 4 by fabricating plural types of thin cylindrical blocks 3 and thick cylindrical blocks 4 which are different from each other in external shape and using a block set that consists of these thin cylindrical blocks 3 and thick cylindrical blocks 4.

The block fabricating apparatus 1, as shown in FIG. 1, is composed of: a bearing side support plate 10 and an insertion side support plate 11 erected in opposite to each other, these plates forming both side plates of a frame body 9 formed in a box shape opening on its top face and front face; a bearing side shaft hole 12 and an insertion side shaft hole 13 which can be rotatably provided by inserting the paper roll-up core shafts 5, 6, these shaft holes opening at opposite positions between the bearing side support plate 10 and the insertion side support plate 11 at the frontal side positions of the frame body 9; a set of turnable columnar compression rollers 14, 15 abutted against the paper roll-up core shafts 5, 6 provided between the bearing side shaft hole 12 and the insertion side shaft hole 13 by being biased from both sides of the top and bottom; a paper thickness display portion 16 for indicating paper thickness dimensions rolled on an external diameter engaged in the cavity portion 7 of the thick cylindrical block 4 together with the set of columnar compression rollers 14, 15 spread as the paper 2 is rolled on the incorporating paper roll-up core shaft; and a guide plate 17 for guiding a distal end side of the paper 2 to the paper roll-up core shafts 5, 6, the guide plate 17 being transversely provided between the bearing side support plate 10 and the insertion side support plate 11 so as be parallel to the shaft core of the paper roll-up core shafts 5, 6 provided between the bearing side shaft hole 12 and the insertion side shaft hole 13, wherein the hole diameters of the bearing side shaft hole 12 and insertion side shaft hole 13 are formed such that the thick paper roll-up core shaft 6 can be turnably inserted.

The thick paper roll-up core shaft 6 is formed in external diameter which is greater than that of the thin paper roll-up core shaft 5. The thin paper, roll-up core shaft 5 is formed in diameter which does not exceed the external diameter of the thick paper roll-up core shaft 6 in a state in which the paper 2 is fully rolled on the thin paper roll-up core shaft 5. At the paper roll-up core shafts 5, 6, as shown in FIG. 2 and FIG. 3, while proximal end portions 5*a*, 5*b* of the paper roll-up core shafts 5, 6 are left, slits 18, 18 for inserting the distal end side of the paper 2 running up to distal ends 5*b*, 6*b* are provided in parallel to the axial core of the paper rollup core shafts 5, 6. In the cavities of the paper roll-up core shafts 5, 6, round bars 19, 19 which are shorter than the entire lengths of the paper roll-up core shafts 5, 6 each are incorporated in a backlash state so as to have an external diameter which is smaller than an internal diameter of the paper roll-up core shafts 5, 6 each and equal to or greater than ½ of the internal diameter. At the proximal end portions 5*a*, 6*a* of the paper roll-up core shafts 5, 6, these bars are fixed to the paper-roll-up core shafts 5, 6, respectively by means of fixing pins 20, 20 penetrating the round bars 19, 19. In this manner, the insides of the paper roll-up core shafts 5, 6 of the slits 18, 18 are formed in the longitudinal cross section arc shape which is inscribed in the paper roll-up core shafts 5, 6 from the side faces of the paper roll-up core shafts 5, 6 towards the inside of the paper roll-up core shafts 5, 6 (refer to FIG. 6 and FIG. 7). Then, the guide plate 17 is positioned along the slits 18, 18 of the paper roll-up core shafts 5, 6 when the paper roll-up core shafts 5, 6 are provided between the bearing side shaft hole 12 and the insertion side shaft hole 13. In this manner, the distal end side of the paper 2 can be inserted by the guide plate 17. In addition, the distal end side of the paper 2 inserted into the slit 18 in accordance with a slit shape formed in the longitudinal cross section arc shape is housed in the arc shape in the paper roll-up shafts 5, 6 so that slip-off is restricted by the round bars 19, 19. Further, the slits 18, 18 are formed up to the distal ends 5*b*, 6*b* on the side faces of the paper roll-up core shafts 5, 6 so that the paper cylinder rolled on the paper roll-up shafts 5, 6 can be easily removed.

At the paper roll-up core shafts 5, 6, as shown in FIG. 1 to FIG. 3, disk shaped handles 21, 21 are fixed such that the paper roll-up core shafts 5, 6 is defined as a rotary shaft at the proximal end portions 5*a*, 6*a* of the paper roll-up core shafts 5, 6. At the outer periphery position on the side faces of the disk shaped handles 21, 21, manually turning grips 22, 22 for manually turning the paper roll-up core shafts 5, 6 are turnably provided. At the disk shaped handle 21 of the thin paper roll-up core shaft 5, as shown in FIG. 3 and FIG. 5, there is integrally provided a columnar boss 23 turnably engaged in the insertion side shaft hole 13 while the axis core of the thin paper roll-up core shaft 5 is defined as a rotary shaft. In the case where the thin paper roll-up core shaft 5 is turnably provided between the bearing side shaft hole 12 and the insertion side shaft hole 13 through the insertion side shaft hole 13, the distal end 5*b* of the thin paper roll-up core shaft 5 is designed so as to be mounted on a columnar bearing 24 with jaw which is turnably engaged in the bearing side shaft hole 12. Thus, on the columnar face of the bearing 24, as shown in FIG. 5, a ring shaped circular groove 25 having a thickness diameter which is equal to that of the thin paper roll-up core shaft 5 is formed around the axial core-of the bearing 24, and is formed in a shape such that the distal end 5*b* of the thin paper roll-up core shaft 5 is engaged in the circular shape 25.

The compression rollers 14, 15, as shown in FIG. 4, are crossed in a scissors shape in the same manner as a pair of insertion side arms 26, 26 crossed in a scissors shape and turnably provided in an axial direction inwardly of the insertion side support plate 11 deeper than the insertion side shaft hole 13. Further, these compression rollers are turnably provided in an axial direction, respectively, at the distal end portions 26*a* and 27*a* and the distal end portions 26*a* and 28*a* abutting against the front face side of the frame body 9 in a pair of bearing side arms 27, 28 turnably provided in an axial direction inwardly of the bearing side support plate 10 positioned relative to the pair of insertion side arms 26, 26 which are deeper than the bearing side shaft hole 12. Then, compression springs 29, 29 are overhung respectively in the vicinity of rear end portions 26*b*, 26*b* of the insertion arms 26, 26 and rear end portions 27*b*, 28*b* of the bearing side arms 27, 28 so as to abut the paper roll-up core shafts 5, 6 provided between the bearing side shaft hole 12 and the insertion side shaft hole 13 to be biased in parallel from the top and bottom. In this manner, the rolled paper cylinder (paper cylinder for thin cylindrical block 3 and paper cylinder for thick cylindrical block 4) is set in an always compressed state, and is rolled up while this state is maintained.

At the rear end portion 27*b* of the bearing side arm 27, a scale plate 31 upwardly erected in an arc shape is provided around an axial core 30 of the bearing side arms 27, 28 which are crossed in a scissors shape. In addition, at the rear end portion 28*b* of the bearing side arm 28, an indicator 33 indicating a paper thickness dimension scale 32 marked on the scale plate 31 is formed, and the paper thickness display portion 16 is composed of the scale plate 31, paper thickness dimension scale 32, and indicator 33. In this manner, as paper 2 is rolled on the paper roll-up core shafts 5, 6, the compression rollers 14, 15 are spread, and the scale plate 31 moves downwardly around-the axial core 30 together with movement of the compression rollers 14, 15. In addition, the rear end portion 28*b* of the bearing side arm 28 moves upwardly around the axial core 30, and the indicator 33 indicates the paper thickness dimension scale 32 so as to indicate the paper thickness dimensions of the paper cylinder rolled on the paper roll-up core shafts 5, 6. In this manner, by the paper thickness display portion 16, it is possible to check whether or not the paper thickness of paper 2 rolled on the incorporating paper roll-up core shaft 5 is in the paper thickness dimensions of paper rolled on the external diameter engaged in the cavity portion 7 of the thick cylindrical block 4.

Now, a method for using the present invention will be described below.

In the case of fabricating the thick cylindrical block 4, as shown in FIG. 1, the thick paper roll-up core shaft 6 is inserted through the insertion side shaft hole 13 of the insertion side support plate 11, and is interposed between the top and bottom compression rollers 14 and 15. In this state, the distal end 6*b* of the thick paper roll-up core shaft 6 is passed through the bearing side shaft hole 12 of the bearing side support plate 10, and the thick paper roll-up core shaft 6 is provided between the bearing side shaft hole 12 and the insertion side shaft hole 13. Then, the thick paper roll-up core shaft 6 is turned with the manually turning grip 22 of the disk shaped handle 21 such that the slit 18 of the thick paper roll-up core shaft 6 is opposed to the distal end portion 17*a* of the guide plate 17. Next, as shown in FIG. 6, the distal end portion of foldout handbill 2 cut into a width within a length of the slit 18 is placed on the guide plate 17, and the distal end side of the handbill 2 is inserted into the slit 18. Then, the distal end side is pushed to be turned around the round bar 19 along the longitudinal cross section arc shaped slit 18 formed in the thick paper roll-up core shaft 6.

Thereafter, by holding the manually turning grip 22, the thick paper roll-up core shaft 6 is rotated in the direction indicated by the arrow A, i.e. , in a direction in which the distal end side of handbill 2 is folded at an opening position of the slit 18, thereby rolling the handbill 2. As shown in FIG. 7, as the handbill 2 is rolled on the thick paper roll-up core shaft 6, the compression rollers 14, 15 are spread against the compression springs 29, 29. If the indicator 33 indicates the paper thickness dimension scale 32 indicating that the paper cylinder for the thick cylindrical block 4 has sufficient rigidity in thickness, rolling of the handbill 2 is stopped. Then, the handbill 2 left on the guide plate 17 is cut in the vicinity of the distal end portion 17*a* of the guide plate 17, and adhesive such as glue is applied onto an end face at the rolled side, and the handbill is bonded on a paper cylinder.

If the thick paper roll-up core shaft 6 is removed from the insertion side shaft hole 13, the slit 18 is formed up to the distal end 6*b* of the thick paper roll-up core shaft 6. Thus, the paper cylinder for thick cylindrical block 4 is interrupted by the insertion side support plate 11, and is removed from the thick paper roll-up core shaft 6 in a state in which the paper cylinder is left in the frame body 9. When the paper cylinder for the thick cylindrical block 4 is cut in a desired length, a thick cylindrical block 4 is produced.

Next, in the case of fabricating the thin cylindrical block 3, as shown in FIG. 5, the bearing 24 is turnably engaged in the bearing side shaft hole 12. Then, the thin paper roll-up core shaft 5 is inserted through the insertion side shaft hole 13, and is interposed between the top and bottom compression rollers 14 and 15. In this state, the distal end 5*b* of the thin paper roll-up core shaft 5 is mounted to be inserted into the circular groove 25 of the bearing 24. At this time, the boss 23 of the handle 21 is turnably engaged in the insertion side shaft hole 13, and the thin paper roll-up core shaft 5 is provided between the bearing side shaft hole 12 and the insertion side shaft hole 13.

Sequentially, as is the case with the thick paper roll-up core shaft 6, the distal end side of handbill 2 is inserted into the slit 18, as shown in FIG. 6. Then, the handbill 2 is rolled, as shown in FIG. 7. As the handbill 2 is rolled on the thin paper roll-up core shaft 5, the compression rollers 14, 15 are spread against the compression springs 29, 29. When the indicator 33 indicates the paper thickness dimension scale 32 indicating the internal diameter dimensions of the thick cylindrical block 4, rolling of the handbill 2 is stopped. Then, the handbill 2 left on the guide plate 17 is cut, and adhesive such as glue is applied onto the paper cylinder, thereby obtaining the paper cylinder for thin cylindrical block 3. When the paper cylinder for the thin cylindrical block 3 is cut in a desired length, the thin cylindrical block 3 is produced.

In the present embodiment, a thick cylindrical block 4 and a thin cylindrical block 3 having an external diameter substantially equal to an internal diameter of the thick cylindrical block 4 can be easily fabricated. Thus, as shown in FIG. 8, the thin cylindrical block 3 can be mounted to be inserted into the cavity portion 7 of the thick cylindrical block 4 in an intimate contact state. As shown in FIG. 9, when the thin cylindrical block 3 is mounted to be inserted into an incorporating hole 8 by drilling the incorporating hole 8 having an internal diameter substantially equal to the external diameter of the thin cylindrical block 3 on the side face of the thick cylindrical block 4, the thin cylindrical block 3 is mounted to be inserted into the thick cylindrical block 4 in an intimate contact state.

By using a block set consisting of the thick cylindrical block 4 and thin cylindrical block 3, the thick cylindrical block 4 and thin cylindrical block 3 can be assembled in arbitrary shapes. Thus, a solid creation can be easily assembled. In addition, newspaper, foldout handbill, package paper, used copying paper and the like can be used for the block set. Thus, characters, illustrations and the like printed on the paper 2 can be used as a picture pattern without requiring a material cost.

In the present embodiment, although the top face and the entire front face of the block fabricating apparatus 1 open, the opening of the front face will suffice if there is a space capable of inserting and placing the paper 2 on the guide plate 17 and capable of removing the rolled paper cylinder. The opening of the top face will suffice if there is a space capable of gluing an end of the paper cylinder and capable of checking the paper thickness dimension scale 32 of the paper thickness display portion 16.

In addition, the compression rollers 14, 15 each may be one or more disk shaped compression rollers.

In addition, a gear system for decelerating rotation meshed with the handle 21 is provided, whereby the paper roll-up core shafts 5, 6 may be rotated by a motor.

Further, the paper thickness display portion 16 is a gauge meter or a liquid crystal distance measuring instrument coupled with the rear end portions 26*b*, 26*b* of the insertion side arms 26, 26 or the rear end portions 27*b*, 28*b* of the bearing arms 27, 28. This display portion may-display a spread width between paired arm rear end portions (26*b* and 26*b* or 27*b* and 28*b*)

Second Embodiment

Figure 10:
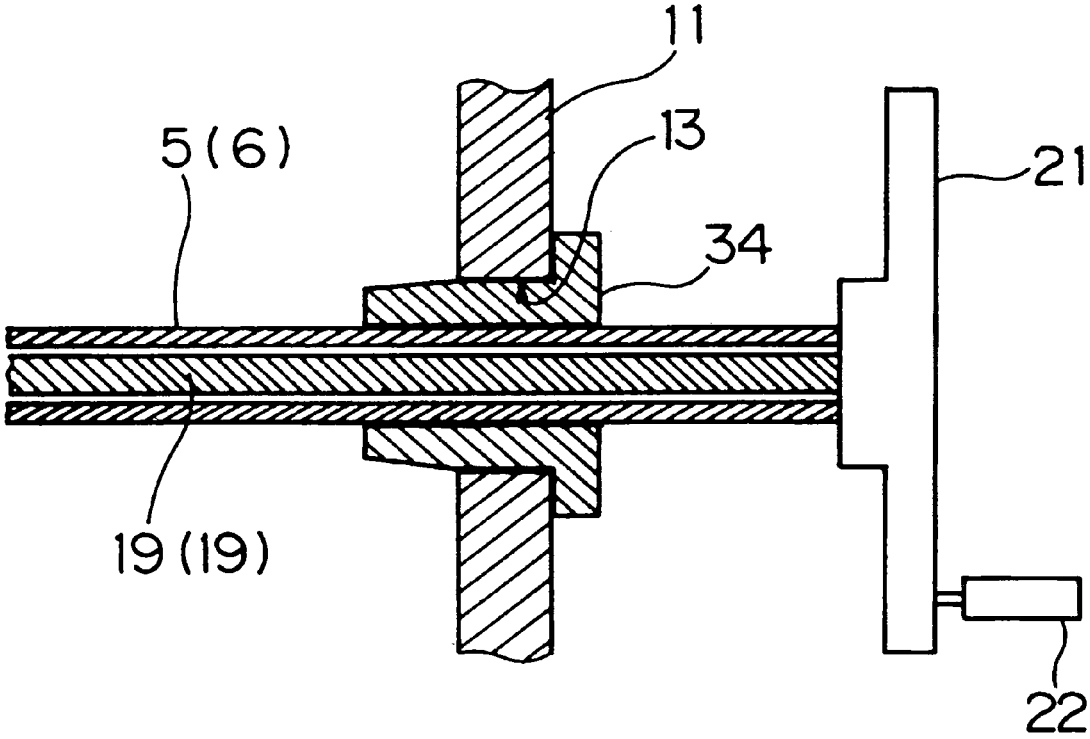
FIG. 10 is a partially omitted front view of a paper roll-up core shaft showing a state in which the paper roll-up core shaft is passed through a shaft hole of an insertion side support plate.
Figure 11:
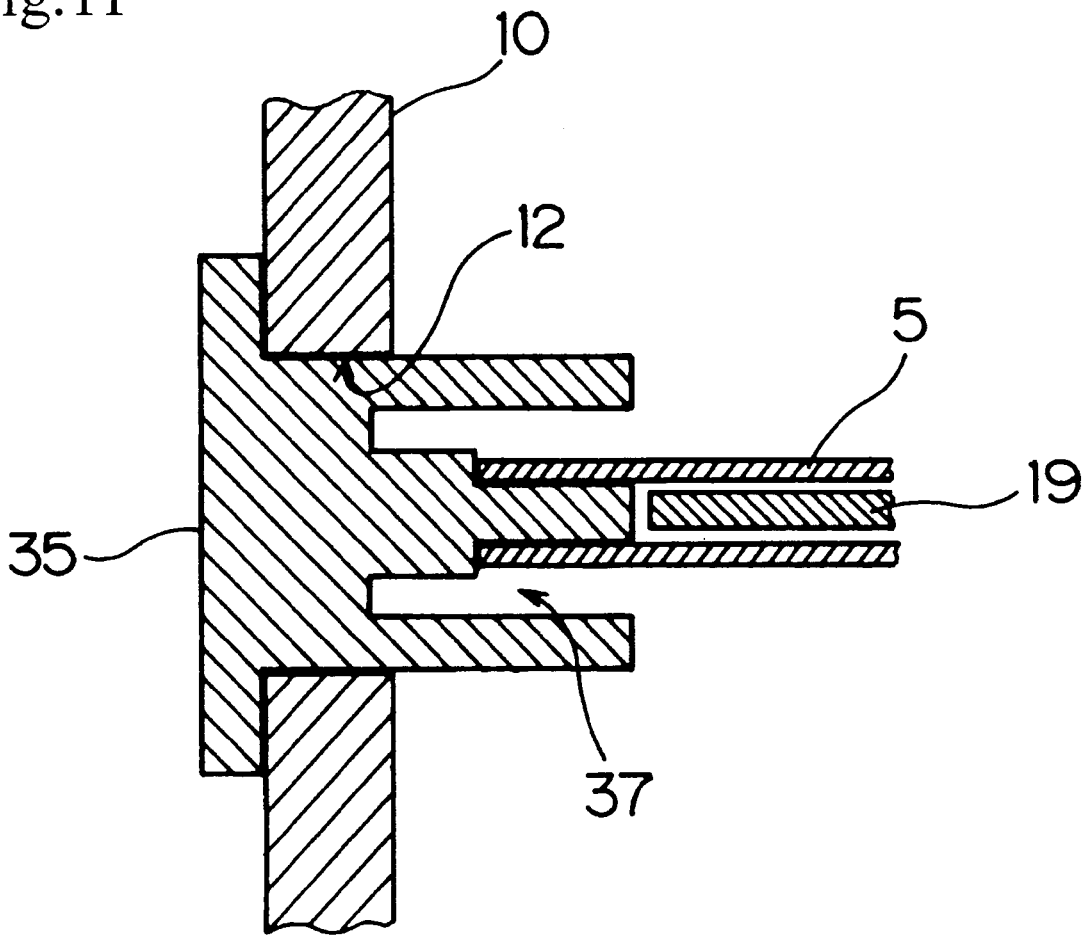
FIG. 11 is a partially omitted longitudinal cross section showing a state in which a paper roll-up core shaft is provided between a bearing shaft hole and an insertion side shaft hole.
Figure 12:
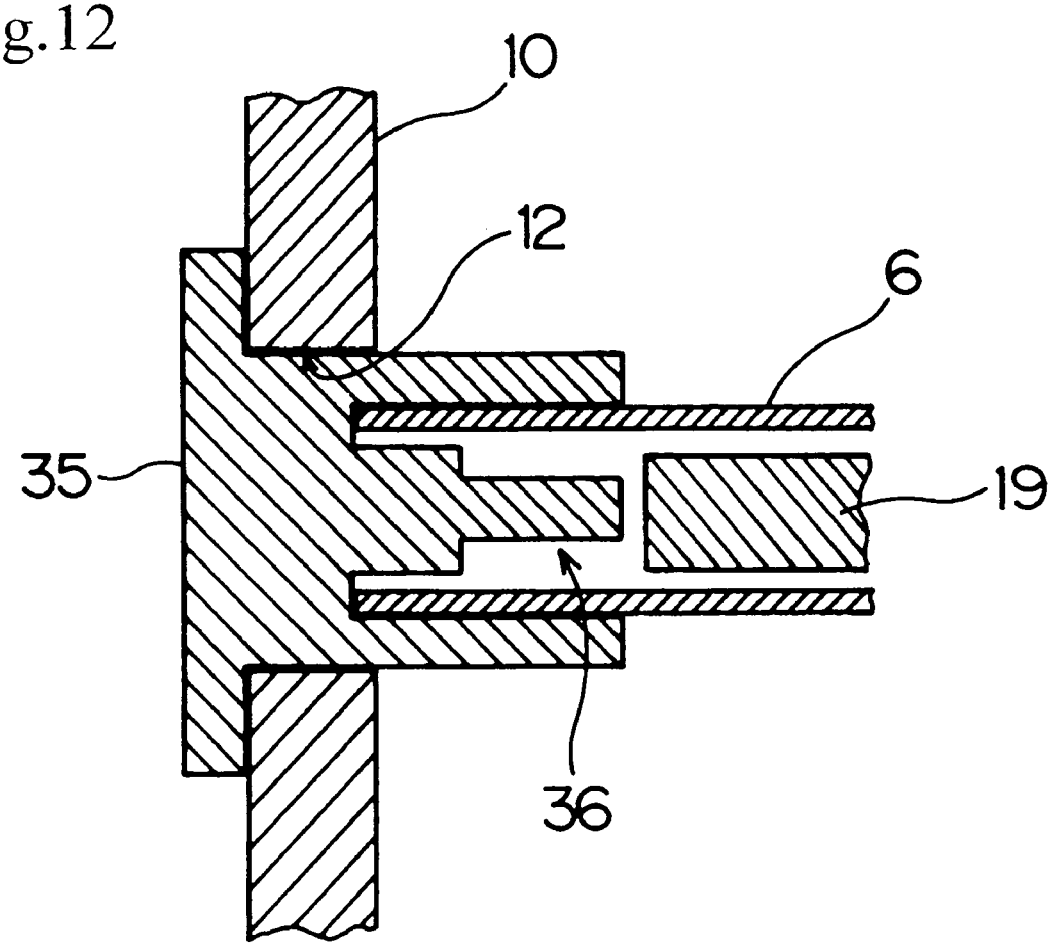
FIG. 12 is a partially omitted longitudinal cross section showing a state in which paper roll-up core shaft is provided between a bearing shaft hole and an insertion side shaft hole.

The present embodiment is a modified example of method for providing the paper roll-up core shafts 5, 6 in the first embodiment between the bearing side shaft hole 12 and the insertion side shaft hole 13. FIG. 10 is a partially omitted front view of a paper roll-up core shaft showing a state in which the paper roll-up core shaft is passed through a shaft hole of an insertion side support plate, wherein the paper roll-up core shaft, support plate, and insertion side bearing are illustrated on a longitudinal cross section passing through the axial core of the paper roll-up core shaft. FIG. 11 is a partially omitted longitudinal cross section showing a state in which an incorporating roll-up core shaft is provided between a bearing side shaft hole and an insertion side shaft hole. FIG. 12 is a partially omitted longitudinal cross section showing a state in which an assembling roll-up core shaft is provided between a bearing side shaft hole and an insertion side shaft hole.

In the modified example shown in FIG. 10, an internal diameter of the insertion side shaft hole 13 is formed to be greater than an external diameter of the thick paper roll-up core shaft 6. Insertion side bearings 34, 34 turnably engaged in insertion side shaft holes 13 are mounted at the position of the insertion side shaft holes 13 of the paper roll-up core shafts 5, 6 in a state in which the paper roll-up core shafts 5, 6 are provided. In addition, the round bars 19, 19 each are provided to be inserted into the handle 21 so that the slits 18, 18 in the paper roll-up core shafts 5, 6 are formed in a longitudinal cross section arc shape.

In the modified example, when the paper roll-up core shafts 5, 6 are removed in a state in which the insertion side bearing 34 with jaw is left in the insertion side shaft hole 13, the paper cylinder for thin cylindrical block 3 or the paper cylinder for thick cylindrical block 4 are blocked by bearings 34, 34, and is left in the frame body 9. Thus, the paper cylinders can be easily removed.

Next, in the modified example shown in FIG. 11 and FIG. 12, an internal diameter of the bearing side shaft hole 12 is formed to be greater than an external diameter of the thick paper roll-up core shaft 6. A bearing 35 with jaw turnably engaged in the bearing side shaft hole 12 is mounted to be inserted into the bearing side shaft hole 12. Then, on a column face of the bearing 35, there are formed an assembling ring groove 36 of a thickness diameter equal to that of the thin paper roll-up shaft 5 around the axial core of the bearing 35 and an assembling ring groove 37 of an internal diameter identical to an external diameter of the assembling paper roll-up core shaft 6 having a groove deeper than the incorporating ring groove 36 including the incorporating ring groove 36.

In the modified example, the ring grooves 36, 37 capable of mounting distal end portions 5*b*, 5*b* of the paper roll-up core shaft 5, 6 on the bearing 35 are formed, thus making it unnecessary to replace bearing engaged in the bearing side shaft hole 12 by the paper roll-up core shaft to be used.

Third Embodiment

Figure 14:
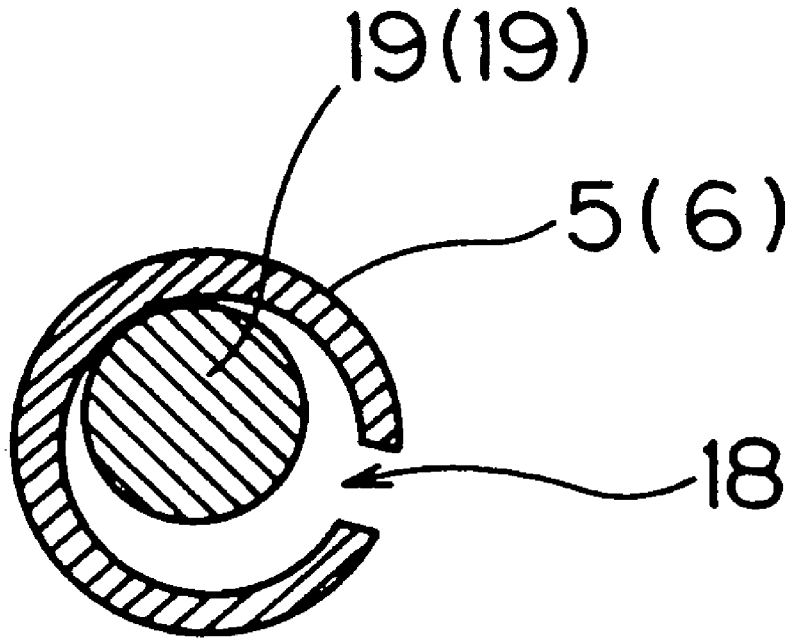
FIG. 14 is an illustrative view of a paper roll-up core shaft.
Figure 15:
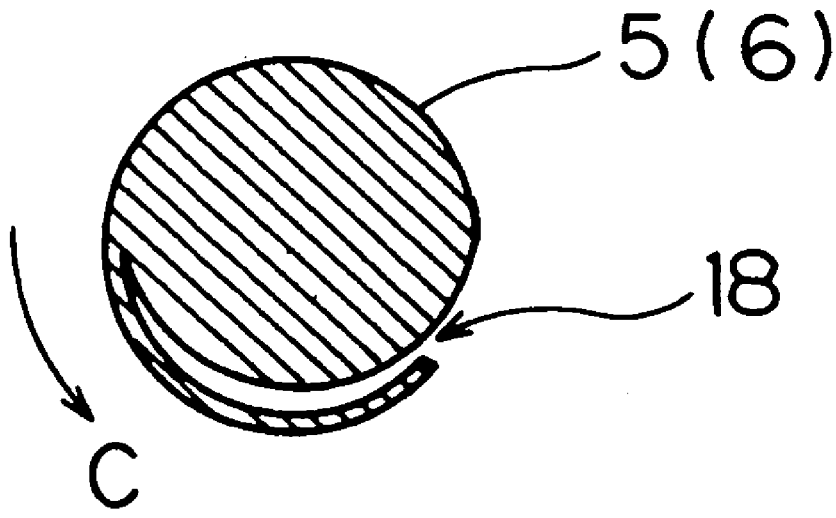
FIG. 15 is an illustrative view of a paper roll-up core shaft.

The present embodiment is a modified example of the slit 18 in the first embodiment. FIG. 13A and FIG. 13B are illustrative views of a paper roll-up core shaft, wherein FIG. 13A is a front view when a slit of the paper roll-up core shaft can be seen, and FIG. 13B are a longitudinal cross section taken along the line B—B in FIG. 13A. FIG. 14 and FIG. 15 are illustrative views of a paper roll-up core shaft, and cross sections equivalent to the longitudinal cross section taken along the line B—B in the paper roll-up core shaft illustrated in FIG. 13A and FIG. 13B.

In a modified example shown in FIG. 13A and FIG. 13B, the paper roll-up core shafts 5, 6 are composed of: a tub type cover 38 formed in a longitudinal cross section semi-arc shape forming the paper roll-up core shafts 5, 6; and an alignment shaft portion 39 a center portion at which narrow paths 39*a*, 39*b* run on both sides rises in a semi-circular shape in which a slit 18 is formed in a state in which an opening width of the slit 18 is left on the side face of the paper roll-up core shafts 5, 6 by mounting the tub type cover 38. The tub type cover 38 is mounted on the alignment shaft portion 39 in a state in which an opening of the slit 18 is formed so as to fix an end face of the tub type cover 38 and the narrow path 39*a* to each other in an intimate contact.

In addition, in a modified example shown in FIG. 14, a round bar 19 is adhered to the internal wall of the paper roll-up core shafts 5, 6 opposed to an opening of the slit 18 so that the opening can be seen. In the modified example as well, a slit 18 formed in a longitudinal cross section arc shape inscribed in the paper roll-up core shafts 5, 6 is formed in the paper roll-up core shafts 5, 6.

Further, in a modified example shown in FIG. 15, the paper roll-up core shafts 5, 6 each consist of round bars. A slit 18 is formed to be cut into a longitudinally cross section arc shape inscribed in the paper roll-up core shafts 5, 6 from the side face of the paper roll-up core shafts 5, 6 toward the inside of the paper roll-up core shafts 5, 6 in a state in which the external shape of the paper roll-up shafts 5, 6 is maintained.

In each of the modified examples as well, the slit 18 formed in a longitudinal cross section arc shape is formed, and thus, advantageous effect similar to that of the first embodiment can be attained.

Figure 13:
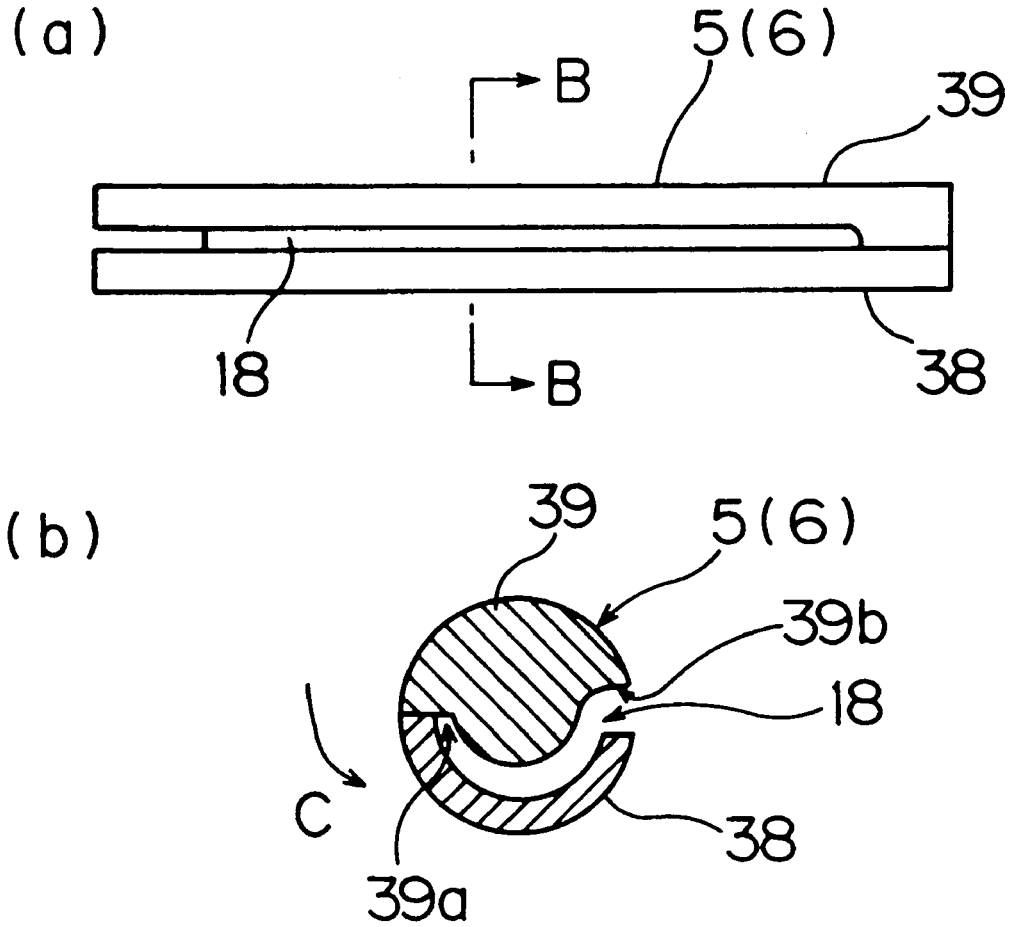
FIG. 13 is an illustrative view of a paper roll-up core shaft.

FIG. 13 and FIG. 15 each show a modified example of the block fabricating apparatus 1 using the paper roll-up core shafts 5, 6. In these figures, a gear rotated only in the direction indicated by the arrow C is provided on the paper roll-up core shafts 5, 6 each, and a claw portion for engagingly locking the gear in a unidirectional manner is provided on the support plate of the frame body 9, whereby a construction for restricting the rotational direction of the paper roll-up core shafts 5, 6 each may be provided.

Fourth Embodiment

Figure 16:
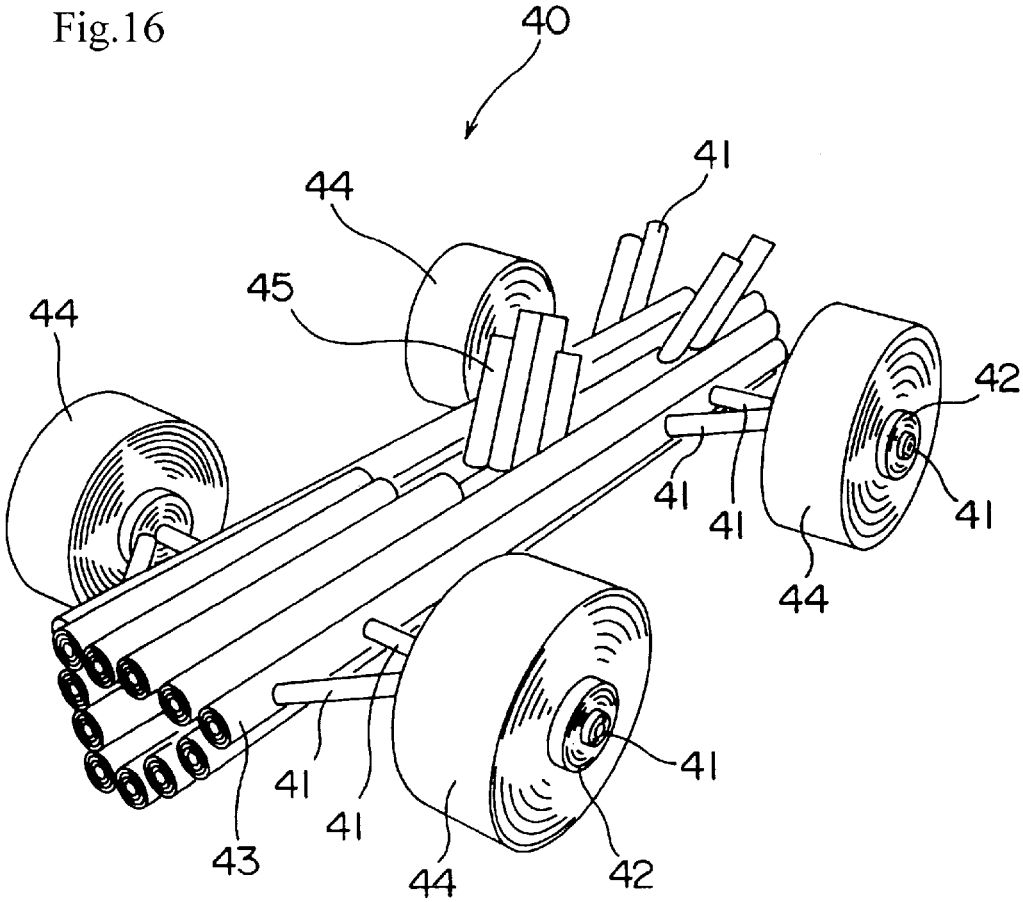
FIG. 16 is a perspective view of a solid creation assembled by a block set for assembly of a solid creation according to one embodiment of the present invention.
Figure 17:
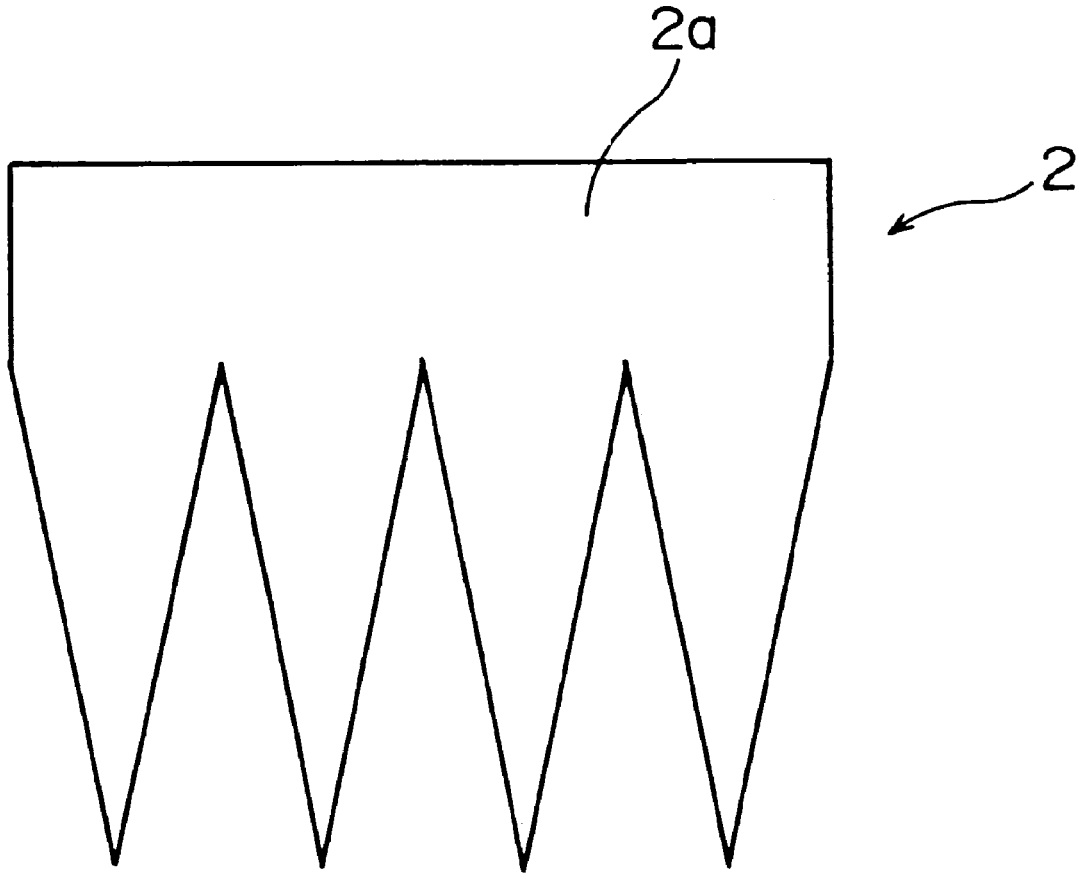
FIG. 17 is a plan view of paper cut in a desired shape.
Figure 18:
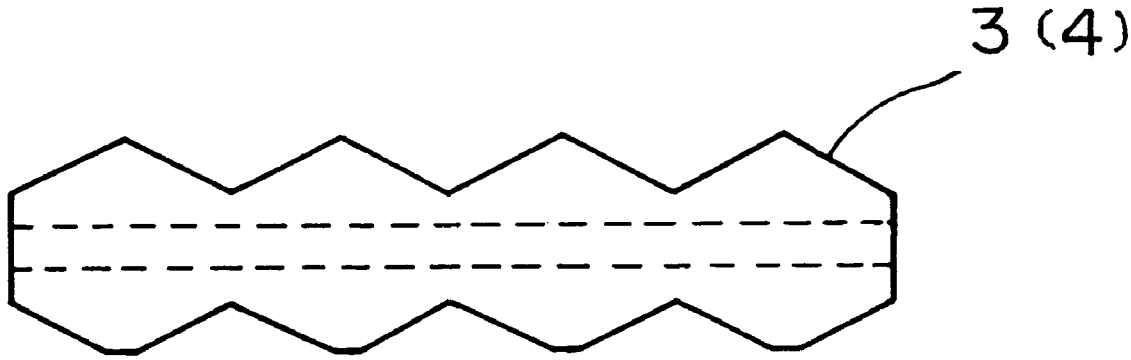
FIG. 18 is a front view of a paper cylindrical block fabricated by paper illustrated in FIG. 17.

FIG. 16 is a perspective view of a solid creation assembled from a block set for assembly of solid creations according to one embodiment of the present invention. FIG. 17 is a plan view of paper cut in a desired shape. FIG. 18 is a front view of a paper cylindrical block fabricated by the paper illustrated in FIG. 17. In these figures, reference numeral 40 denotes a racing car shaped solid creation assembled by using a block set that is composed of a first paper cylindrical block 41, a second paper cylindrical block 42, a third paper cylindrical block 43, a fourth paper cylindrical block 44, and a fifth paper cylindrical block 45. The first paper cylindrical block 41 is incorporated as a wheel and a muffler. The second paper cylindrical block 42 is incorporated as a wheel bearing. The third paper cylindrical block 43 is incorporated as a body. The fourth paper cylindrical block 44 is incorporated as a wheel. The fifth paper cylindrical block 45 is incorporated as a seat.

In addition, reference numeral 40 that is a racing car shaped solid creation assembled by using a block set for assembly of a solid creation according to one embodiment of the present invention, is fabricated with a total of 36 cylinders. In the first paper cylindrical block 41, 8 cylinders are incorporated as wheels and 4 cylinders are incorporated as mufflers, respectively. In the second paper cylindrical block 42, 4 cylinders are incorporated as wheel bearings. In the third paper cylindrical block 43, 12 cylinders are incorporated as a body. In the fourth paper cylindrical block 44, 4 cylinders are incorporated as wheels. In the fifth paper cylindrical block 45, 4 cylinders are incorporated as seats. A racing car after fabricated is movable in that, in the case where the car is provided as accessories, the car has strength such that one can play it by holding it by hand, and wheels are manually moved. However, no consideration is taken into fabricating a racing car of size such that at least one child actually rides.

The first paper cylindrical block 41 is a thin cylindrical block 3 fabricated by using the thin paper roll-up core shaft 5. The second paper cylindrical block 42 and the third paper cylindrical block 43 each have an internal diameter such that the first paper cylindrical block 41 can be mounted. The first paper cylindrical block 41 is mounted to be inserted into the incorporating hole 8 formed on the side face of the third paper cylindrical block 43. In response to the first paper cylindrical block 41, the thick cylindrical block 4 is fabricated by using the assembling paper roll-up core shaft 6. The fourth paper cylindrical block 44 is formed in internal diameter capable of mounting the second paper cylindrical block 42. Thus, in response to the second paper cylindrical block 42, the thick cylindrical block 4 is fabricated by using another assembling paper roll-up core shaft 6. In addition, the fifth paper cylindrical block 45 is fabricated in an external diameter which is smaller than an external diameter of the third paper cylindrical block 43.

In addition, a predetermined extent of strength is produced in the block set fabricated by rolling it in a layered manner. It is not considered easy to drill a hole on the side face of the thick cylindrical block 4 which is cylindrically shaped. However, it is possible to completely insert the thin cylindrical block 3 into the thick cylindrical block 4, since a hole can be drilled by a dedicated drilling device, the hole being equal to an external diameter of the thin cylindrical block 3 rolled by the corresponding device.

Therefore, in a block set consisting of these five types of blocks, the thinner first paper cylindrical block 41 is defined as a thin cylindrical block 3, and the thickest fourth paper cylindrical block 44 is defined as a thick cylindrical block 4. Then, the second paper cylindrical block 42 having thickness which is between these thinner and thickest cylindrical blocks is defined as a thick cylindrical block 4 in response to the first paper cylindrical block of an external diameter which can be engaged in the cavity portion 7 of the paper cylindrical block 42. On the other hand, the cylindrical block 42 is defined as a thin cylindrical block 3 in response to the fourth paper cylindrical block 44 having the cavity portion 7 capable of engaging this paper cylindrical block 42. Thus, the paper roll-up core shaft for fabricating the second paper cylindrical block 42 may be an thin paper roll-up core shaft 5 or an assembling paper roll-up core shaft 6.

Next, as shown in FIG. 17, for example, package paper 2 is cut in the shape of teeth of a comb while a paper face 2*a* for forming a cavity portion is left, and is rolled on the paper roll-up shafts 5, 6. In this manner, a thin cylindrical block 3 or a thick cylindrical block 4 formed in the skewing gem shape can be obtained, as sown in FIG. 18.

In addition, FIGS. 29, 30, 31, and 32 are photographs of dinosaur, closer look of a head portion of dinosaur, air-plane, and Ferris wheel as a completed assembly illustrating not only the assembly, but the appearance with the colors of the paper.

Fifth Embodiment

Figure 19:
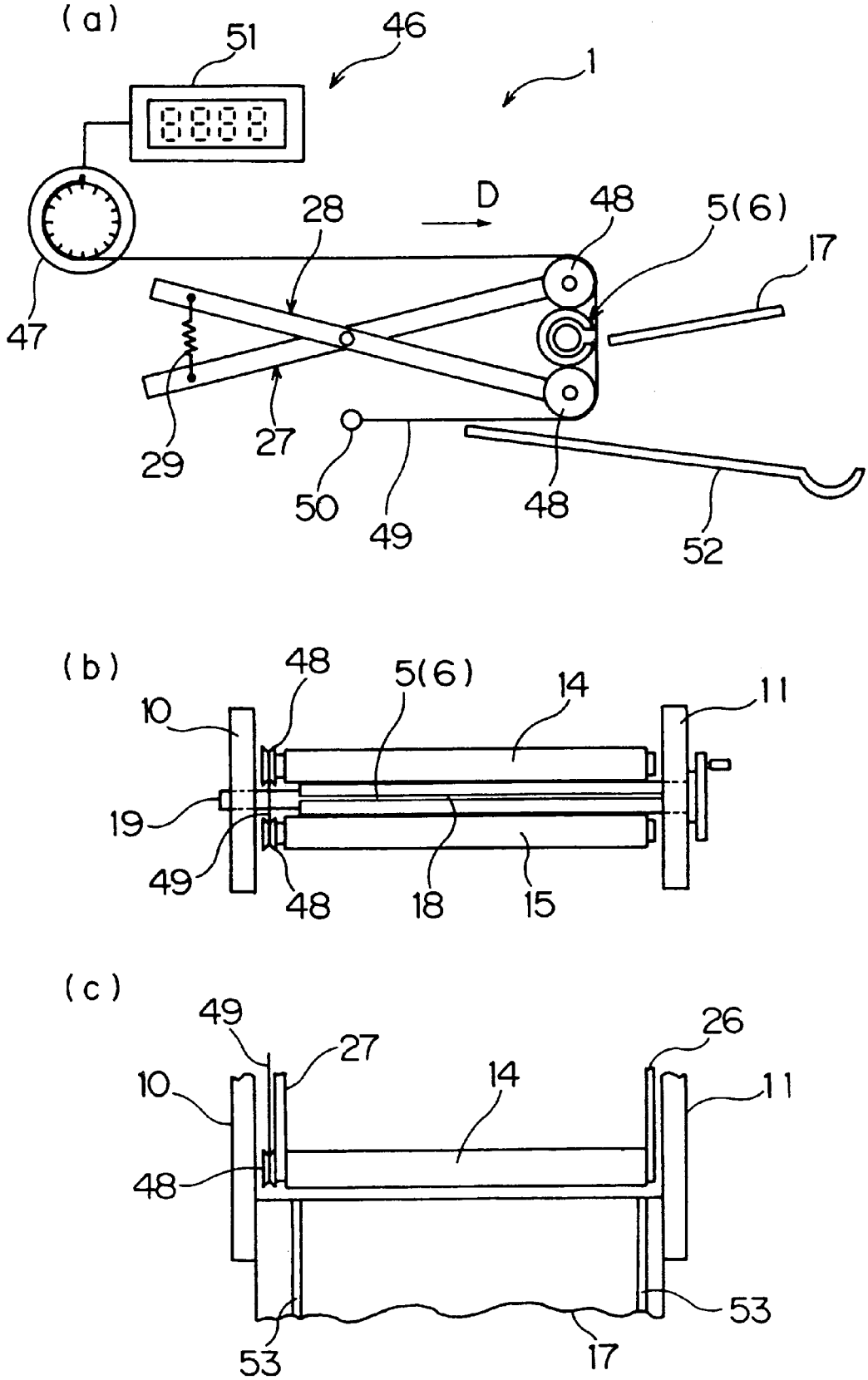
FIG. 19 is an illustrative view of an apparatus for fabricating blocks for assembly of a solid creation according to one embodiment of the present invention.

The present embodiment is a modified example of the paper thickness display portion in the first embodiment. FIG. 19A to FIG. 19C each are illustrative views of an apparatus for fabricating blocks for assembly of a solid creation according to one embodiment of the present invention. FIG. 19A is a side view of an apparatus for fabricating blocks for assembly a solid creation. FIG. 19B is a front view of the apparatus for fabricating blocks for assembly a solid creation illustrated in FIG. 19A. FIG. 19C is a partially omitted plan view showing a front face portion of the apparatus for fabricating blocks for assembling a solid creation illustrated in FIG. 19A. In FIG. 19A, a frame body is omitted, and in FIG. 19B, a guide plate is omitted. In these figures, the same or like elements as those in FIG. 1 to FIG. 18 are designated by the same or like reference numerals. Reference numeral 46 denotes a distance measuring instrument (paper thickness display portion) for digitally displaying paper thickness dimensions of paper 2 rolled on the paper roll-up shaft 5 (6) based on a rotation angle of a rotary encoder 47.

The distance measuring instrument 46 is composed of: the rotary encoder 47 arranged at the rear portion of the frame body 9; U-grooved pulleys 48, 48 turnably mounted in an axial direction on the end portion at the side of the bearing side support plate 10 of the compression rollers 14, 15; a wire 49 for fixing one end of the wire 49 to a wire stop 50 provided on the bearing side support plate 10 and for fixing the other end to the rotary encoder 47 while the wire is overhung on the U-grooved pulleys 48, 48; and a liquid crystal display board 51 for digitally displaying a distance upon the receipt of a distance signal based on a rotation angle from the rotary encoder 47.

In FIG. 19A, reference numeral 52 denotes a guide passage for removing a rolled paper cylinder. In FIG. 19C, reference numerals 53, 53 denote shielding walls for guiding the distal end side of the paper 2 to the slit 18 (18) of the paper roll-up core shaft 5 (6). In addition, the paper roll-up core shaft 5 (6) in the present embodiment is thinly formed up to its distal end including a position abutted against the U-grooved pulleys 48, 48 when the paper roll-up core shaft 5 (6) is provided. The external diameter of the U-grooved pulleys 48, 48 each is substantially equal to that of the compression rollers 14, 15 each.

In the present embodiment, after the paper 2 has been rolled on the paper roll-up core shaft 5 (6), when the compression rollers 14, 15 are spread, the wire 49 is pulled in the direction indicated by the arrow D in FIG. 19A. Then, the rotary encoder 47 rotates, and this rotation angle is transmitted to the liquid crystal display board 51 so as to display paper thickness dimensions on the liquid crystal display board 51.

In the present embodiment as well, advantageous effect similar to that of the first embodiment can be attained.

In the fifth embodiment, the rotation angle of the rotary encoder 47 is directly indicated by a meter gauge, whereby the paper thickness dimensions may be displayed. In this case, the liquid crystal display board 51 is not required.

Sixth Embodiment

Figure 20:
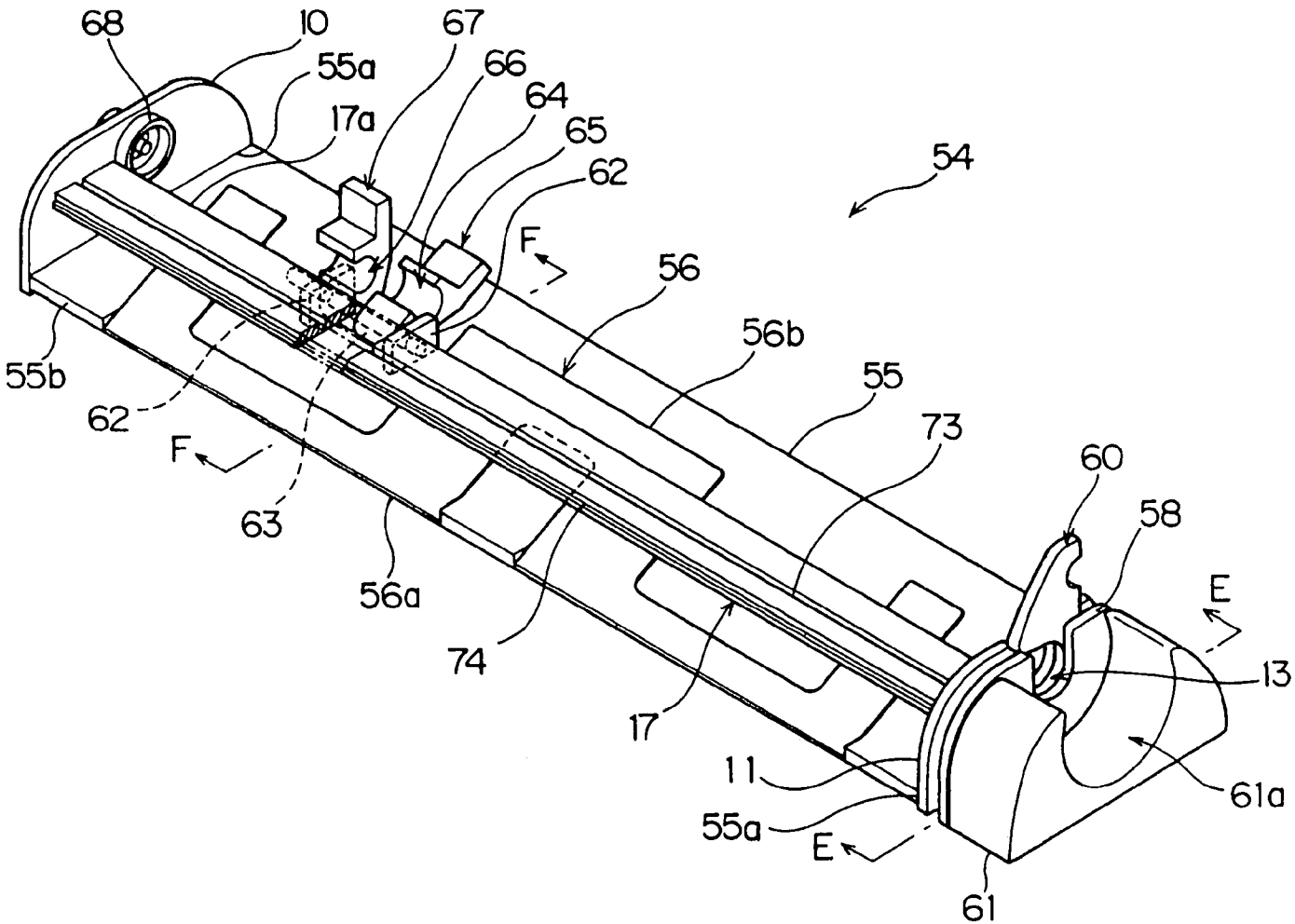
FIG. 20 is a perspective view showing a main body of an apparatus for fabricating blocks for assembly of a solid creation according to one embodiment of the present invention.
Figure 21:
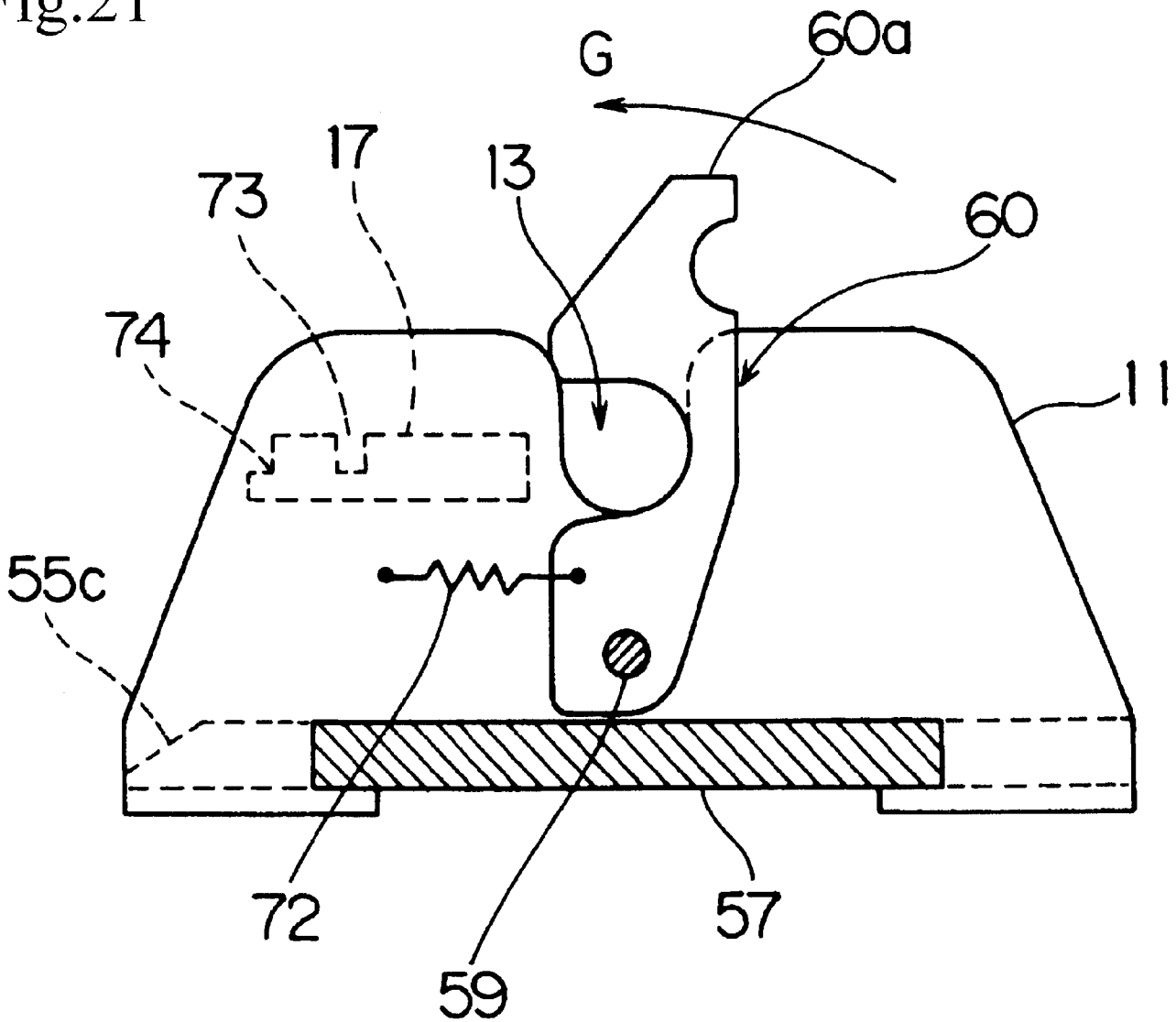
FIG. 21 is a longitudinal cross section taken along the line E—E of the main body illustrated in FIG. 20.
Figure 23:
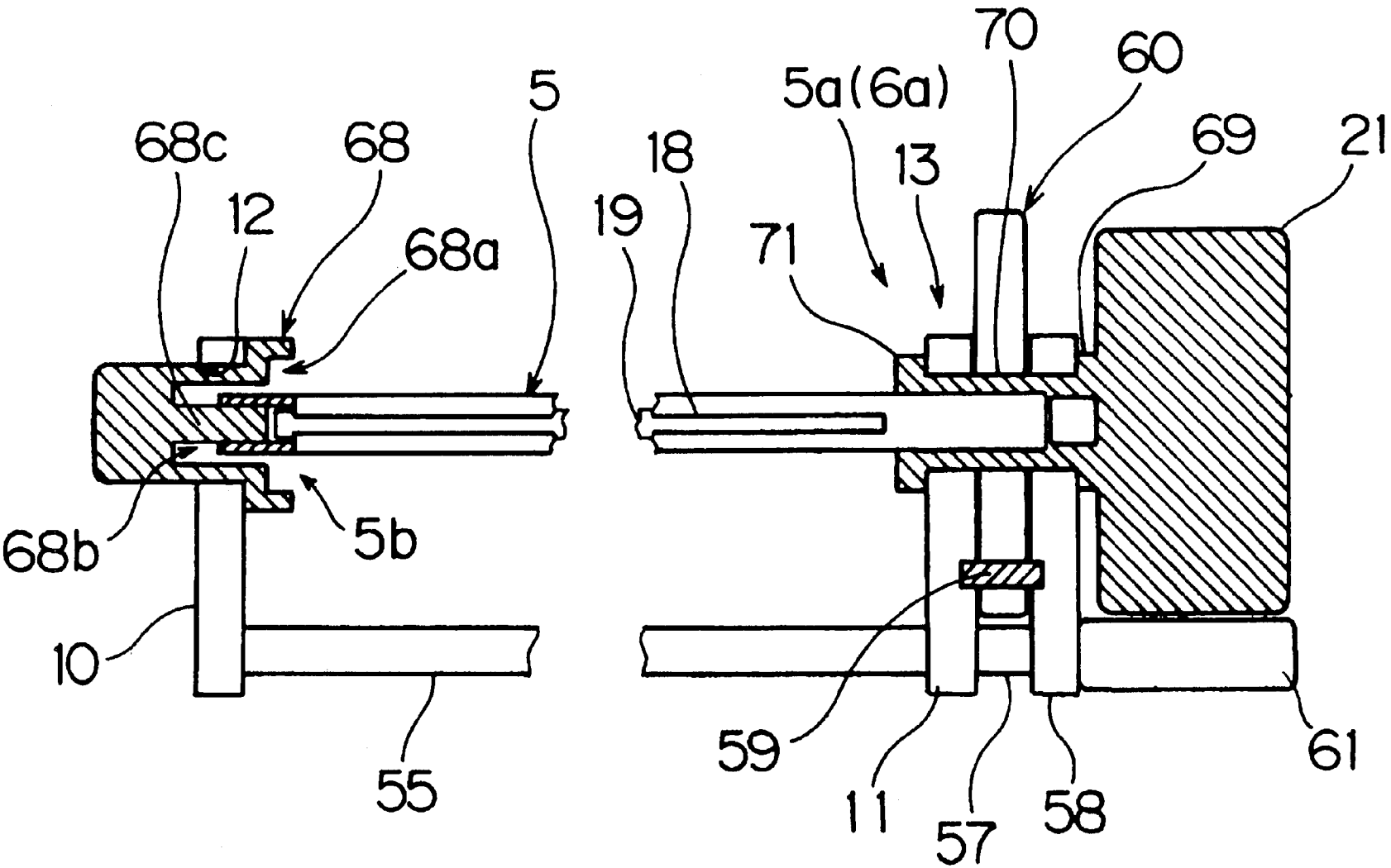
FIG. 23 is a partially omitted front view showing a paper roll-up core shaft of an apparatus for fabricating blocks for assembly of a solid creation according to one embodiment of the present invention.
Figure 24:
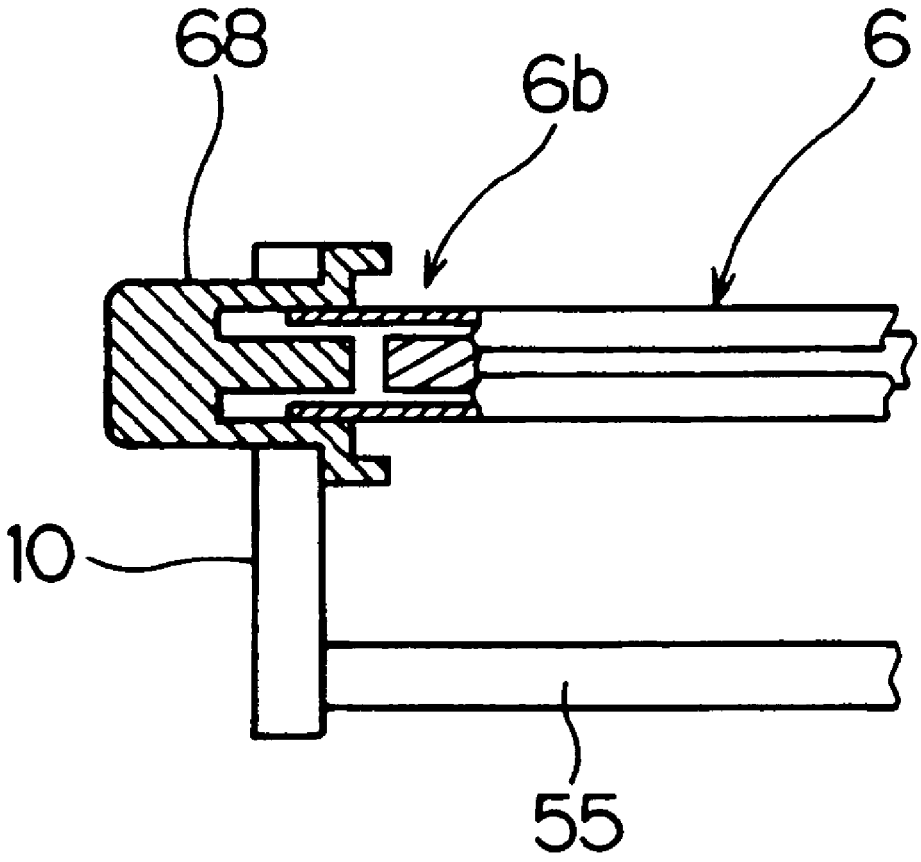
FIG. 24 is a partially omitted front view showing a paper roll-up core shaft.
Figure 25:
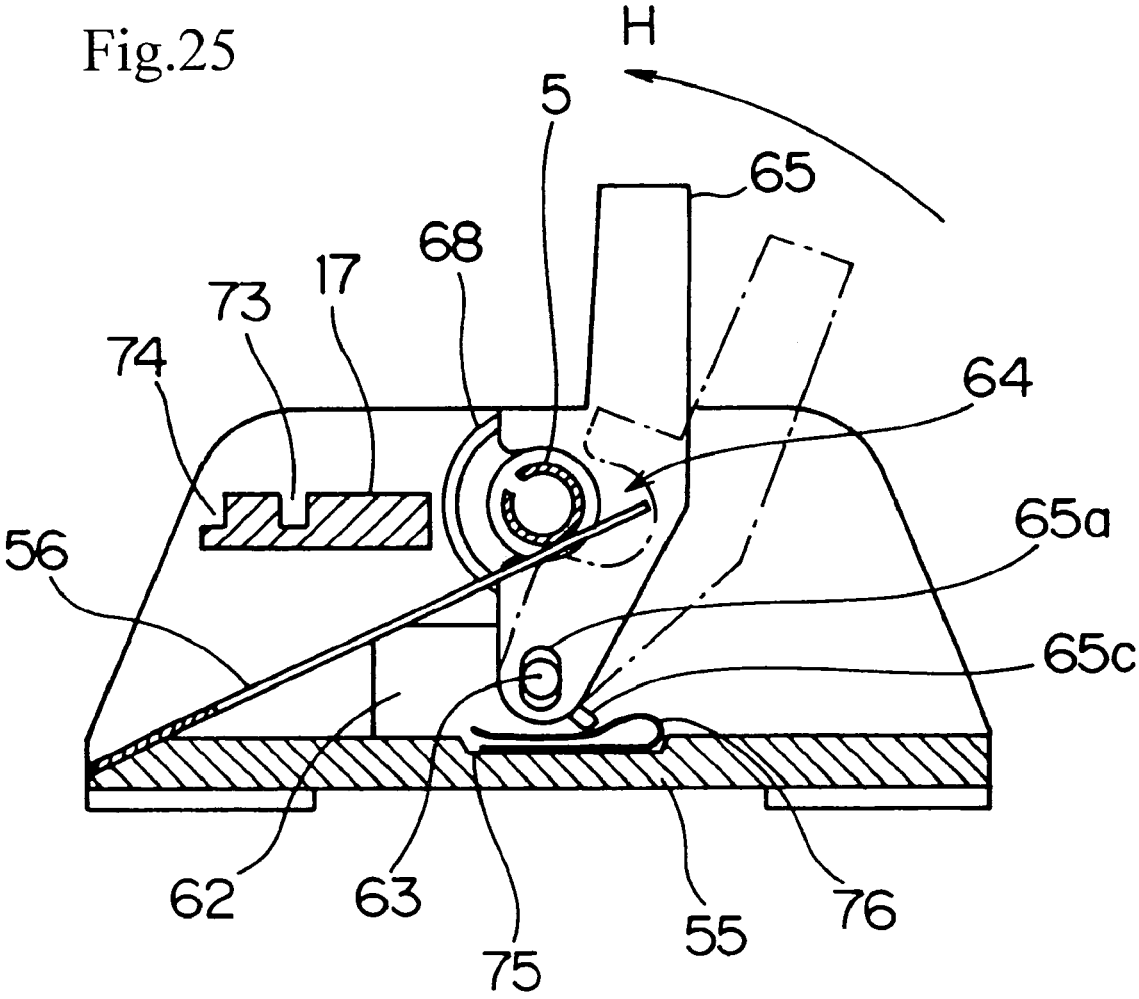
FIG. 25 is a longitudinal cross section taken along the line F—F showing a state in which a paper roll-up core shaft is mounted on the main body.
Figure 26:
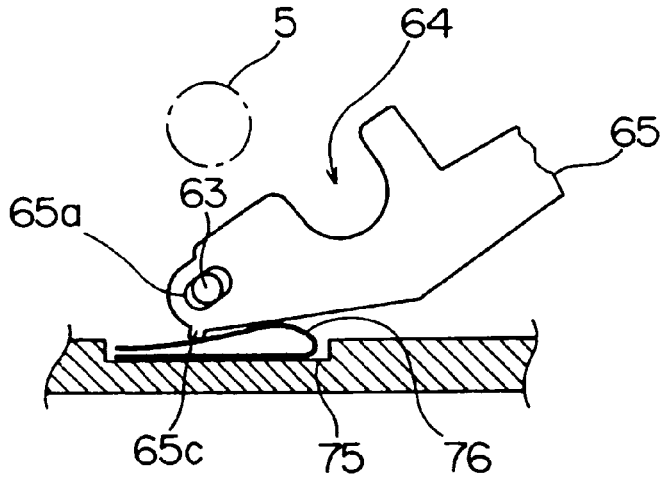
FIG. 26 is a side view illustrating a positional relationship between a paper thickness recognizing arm and a plate spring.
Figure 26:
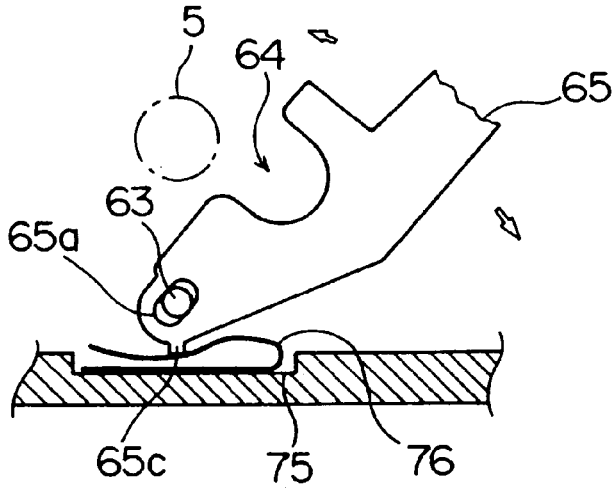
Figure 26:
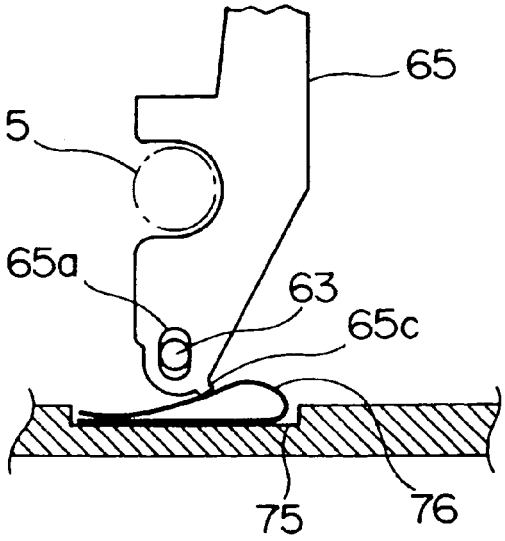
Figure 27:
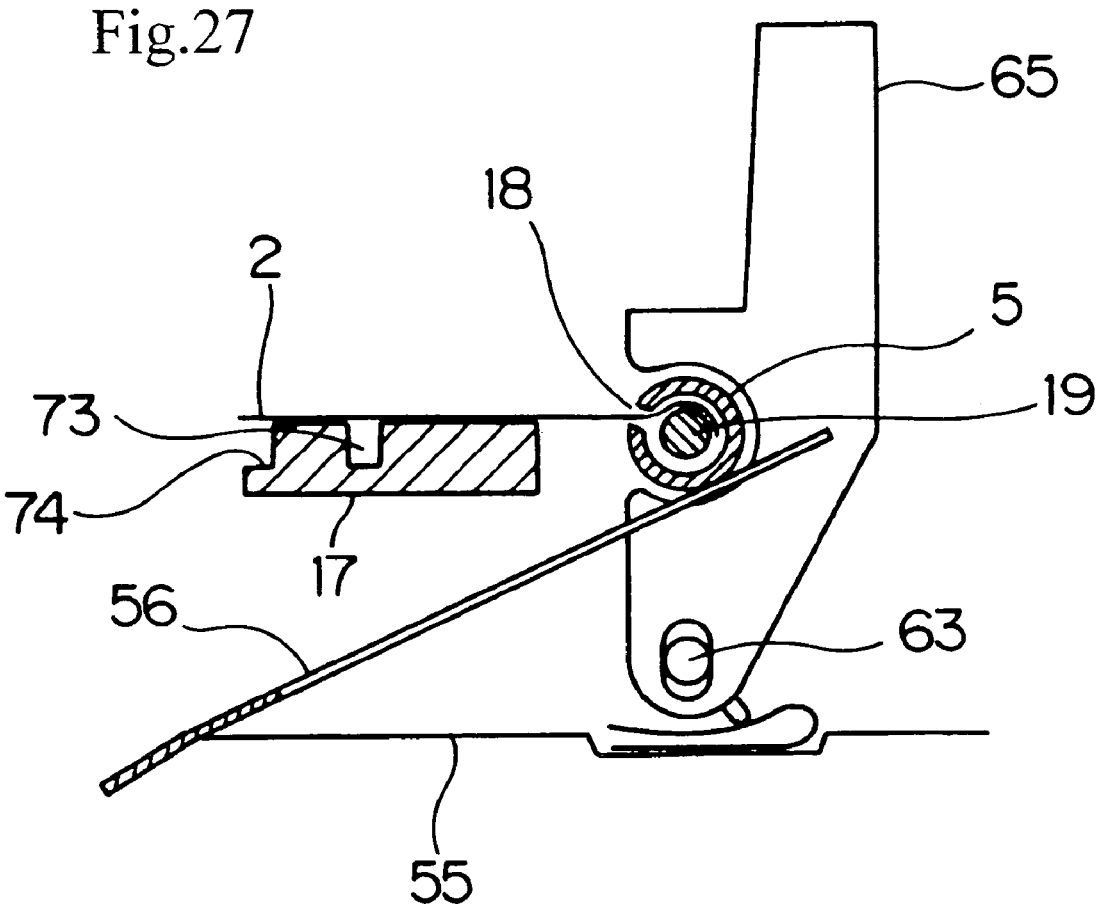
FIG. 27 is a side view illustrating a positional relationship between a rolled paper cylinder and a paper thickness recognizing arm portion.
Figure 28:
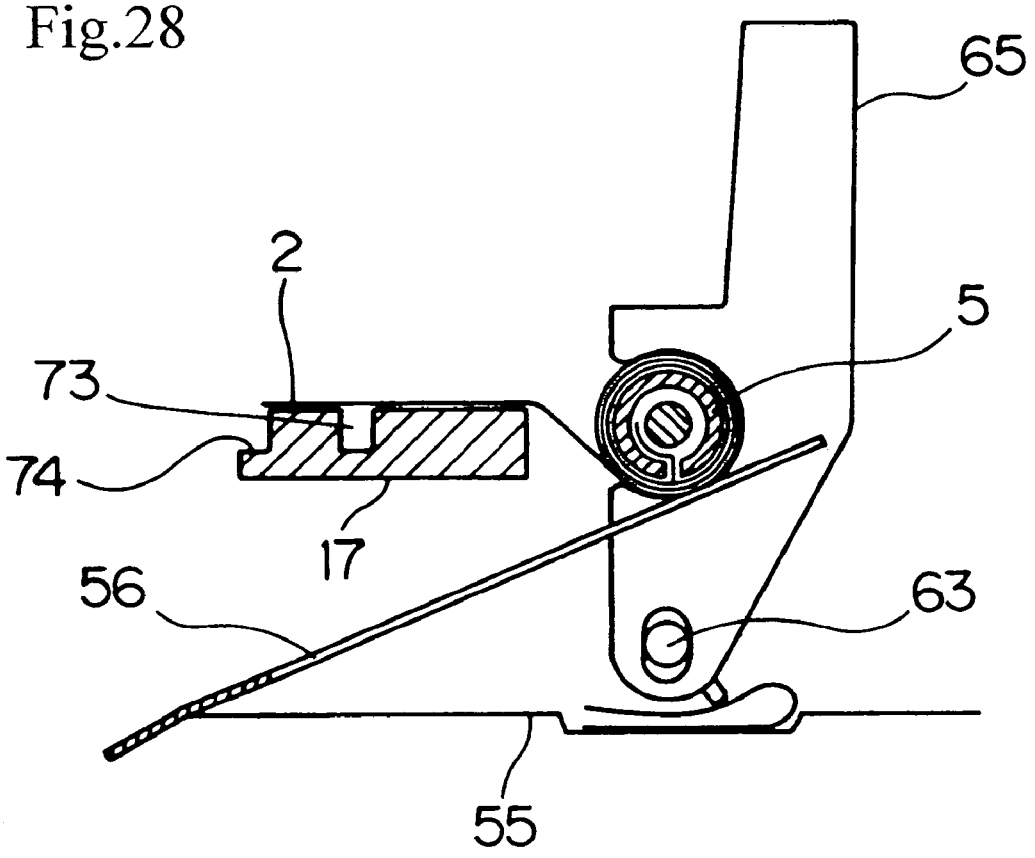
FIG. 28 is a side view illustrating a positional relationship between a rolled paper cylinder and a paper thickness recognizing arm portion.
Figure 29:
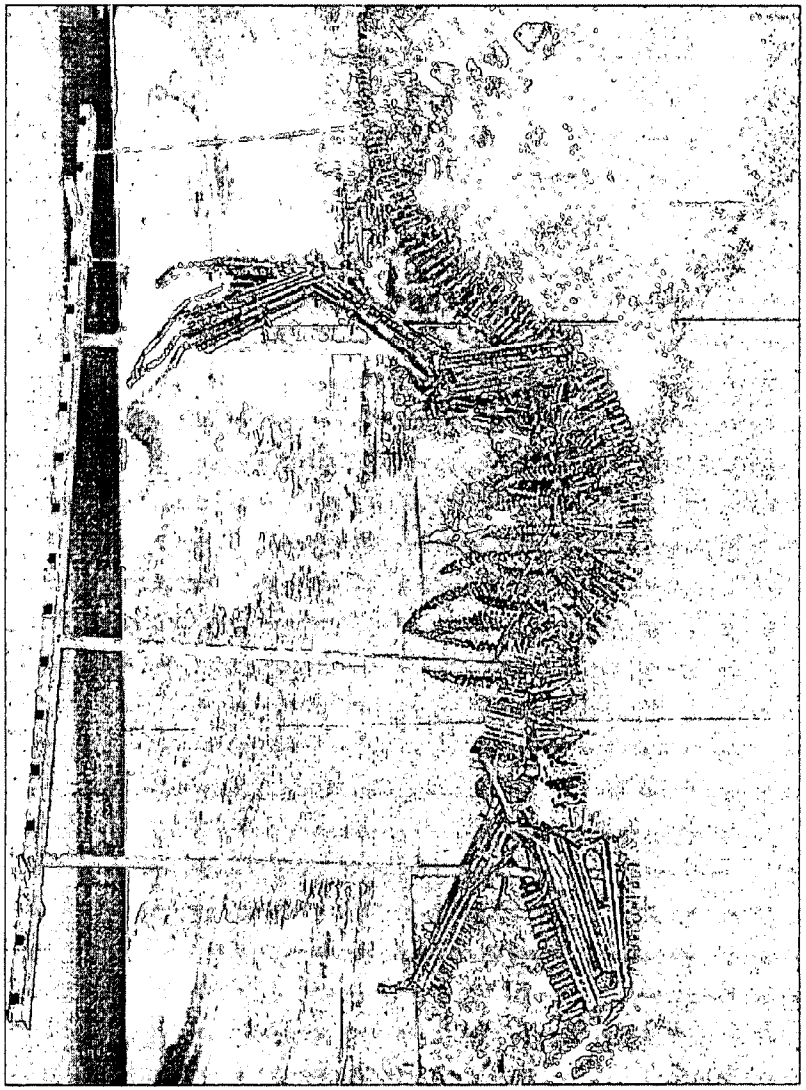
FIG. 29 is a side view of a dinosaur assembled by a block set for assembly of a solid creation according to one embodiment of the present invention.
Figure 30:
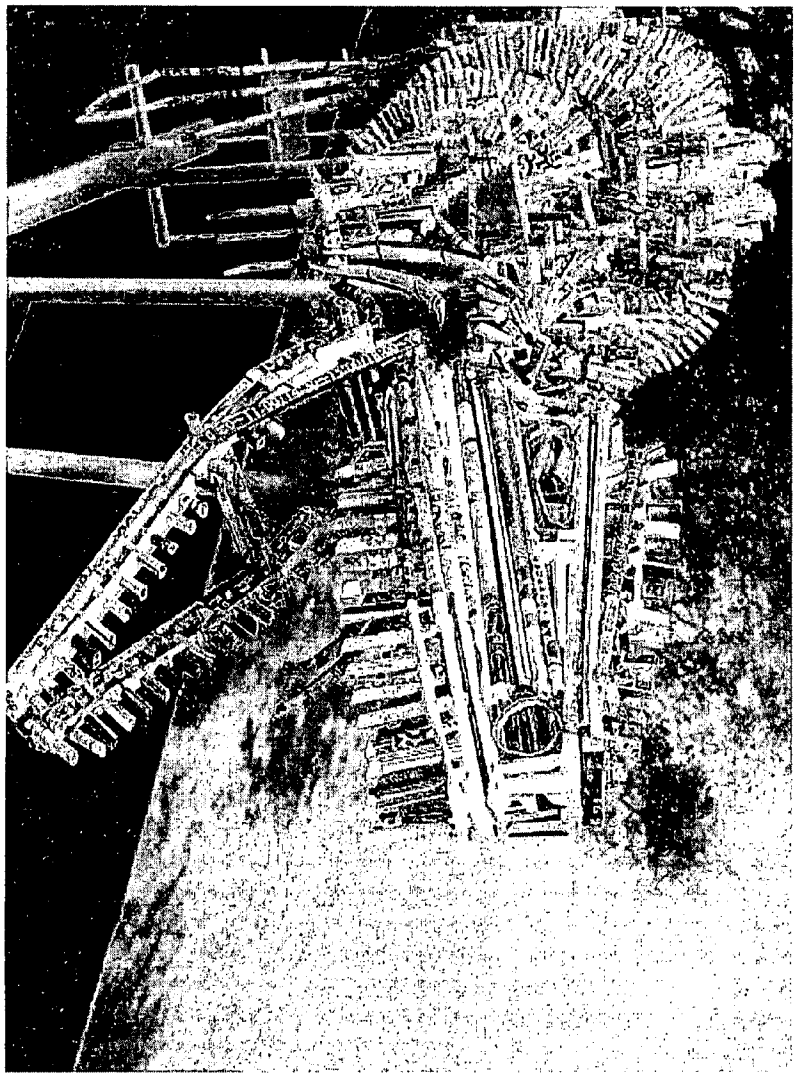
FIG. 30 is a perspective view of a head portion of solid creation introduced by FIG. 29.
Figure 31:
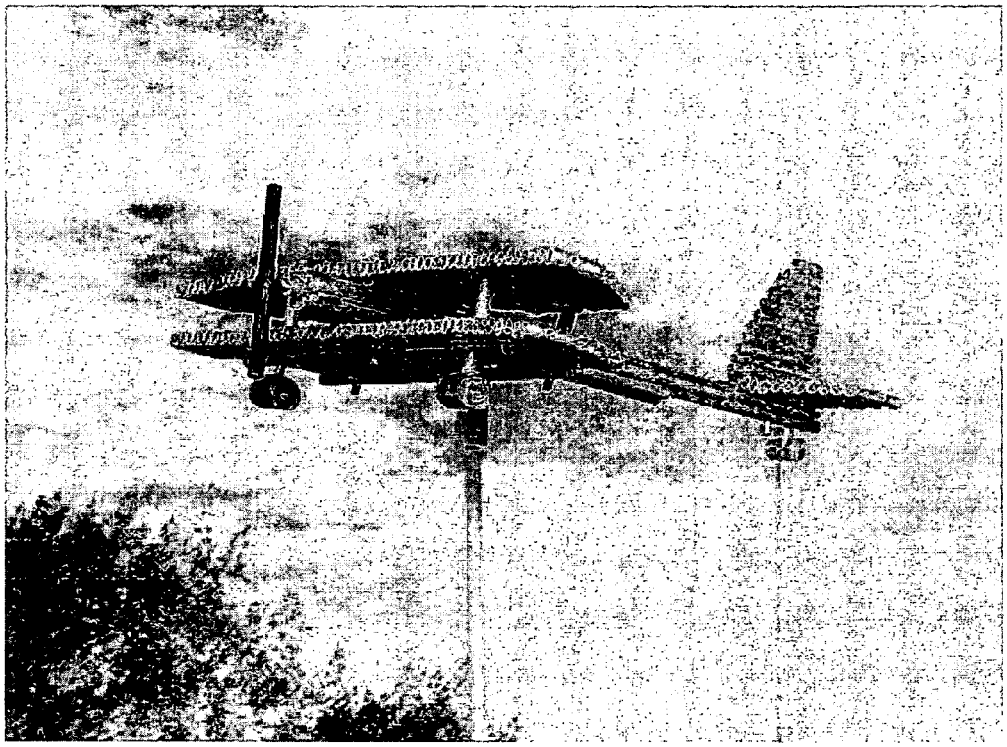
FIG. 31 is a perspective view of an air plane assembled by a block set for assembly of a solid creation according to one embodiment of the present invention.
Figure 32:
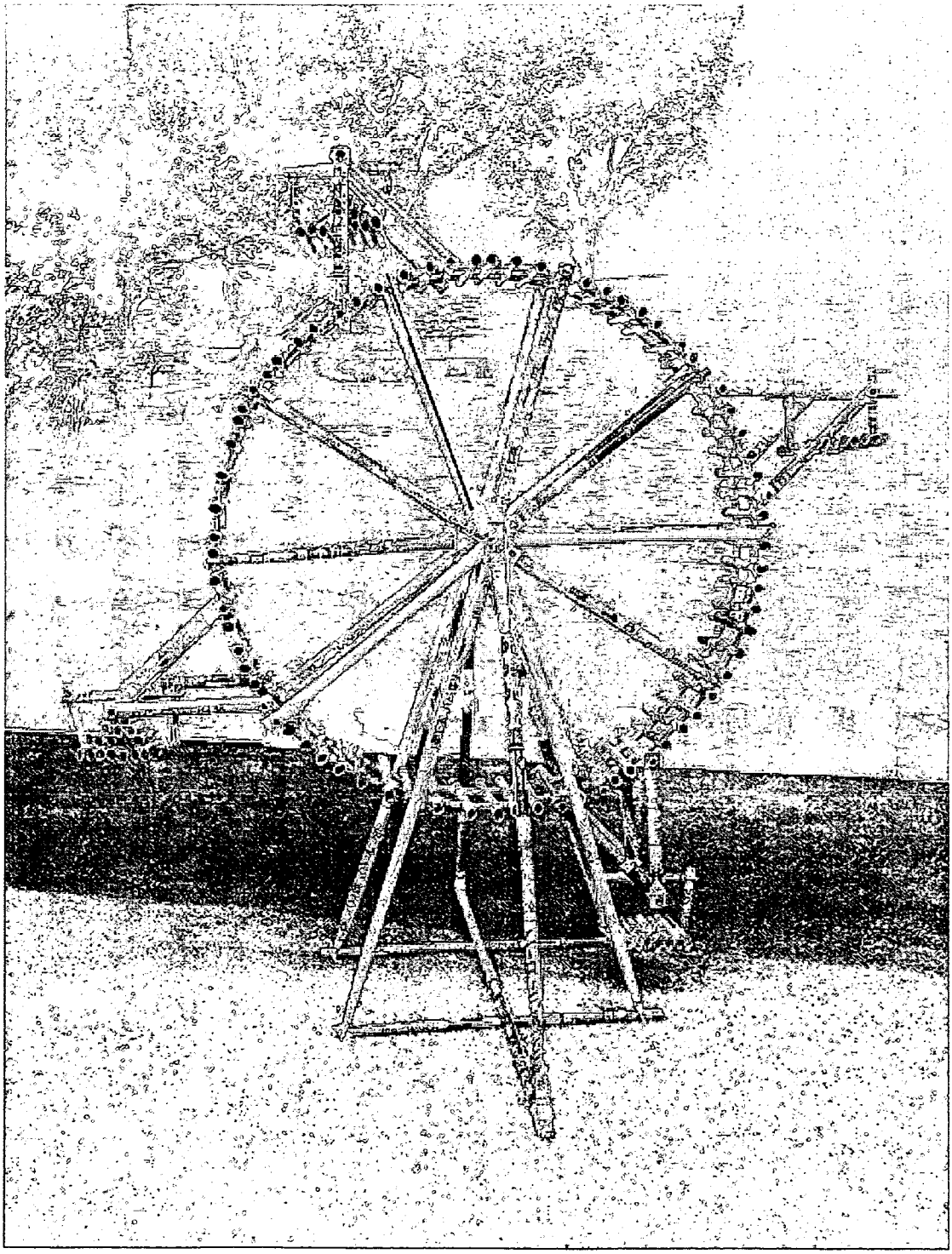
FIG. 32 is a front view of a Ferris wheel assembled by a block set for assembly of a solid creation according to one embodiment of the present invention.

FIG. 20 is a perspective view showing a main body of an apparatus for fabricating blocks for assembly of a solid creation according to one embodiment of the present invention. FIG. 21 is a longitudinal cross section taken along the line F—F of the main body illustrated in FIG. 20. FIG. 23 is a partially omitted front view showing an incorporating paper roll-up core shaft of an apparatus for fabricating blocks for assembly a solid creation according to one embodiment of the present invention. FIG. 24 is a partially omitted front view of an apparatus for fabricating blocks for assembly a solid creation according to one embodiment of the present invention. In FIG. 23, the distal end side and proximal end side of the incorporating paper roll-up core shaft are illustrated on a longitudinal cross section plane. In FIG. 24, the distal end side of the assembling paper roll-up core shaft is illustrated on a longitudinal cross section plane, and the proximal end side is omitted. FIG. 25 is a longitudinal cross section taken along the line F—F showing a state in which the incorporating paper roll-up core shaft is mounted on the main body. FIG. 26A to FIG. 26C each are side views illustrating a positional relationship between a paper thickness recognizing arm portion and a plate spring, wherein FIG. 26A shows a standby state of the paper thickness recognizing arm portion; FIG. 26B shows an intermediate state between the standby state and a state when the arm portion is engaged with the paper roll-up core shaft; and FIG. 26C shows a state in which the paper thickness recognizing arm portion is engaged with the paper roll-up core shaft. FIG. 27 and FIG. 28 each are side views illustrating a positional relationship between a rolled paper cylinder and the paper thickness recognizing arm portion. In these figures, the same or like elements as those in FIG. 1 to FIG. 3, FIG. 5, and FIG. 8 to FIG. 12 are designated by the same or line reference numerals. In FIG. 20, a guide plate is partially omitted.

The apparatus for fabricating blocks for assembly of a solid creation in the present embodiment consists of a main-body 54, a cylindrically shaped thin paper roll-up core shaft 5 (refer to FIG. 23), and a cylindrically shaped assembling paper roll-up core shaft 6 (refer to FIG. 24). The main body 54 is composed of: a rectangular base plate 55; a substantially trapezoidal bearing side support plate 10 and insertion side support plate 11 erected in opposite to both short sides 55*a*, 55*b* of the base plate 55, these plates each having formed a bearing side shaft hole 12 (refer to FIG. 23) and an insertion side shaft hole 13 (refer to FIG. 21) at relative positions; a thin plate 56 fixed to an inclined face 55*c* at a tilt angle produced diagonally upwardly through an axial core of the paper roll-up core shafts 5, 6 positioned between the bearing side support plate 10 and the insertion side support plate 11 when one end side 56*a* of an elastic thin plate,56 having a resilient force is aligned with an upwardly inclined face 55*c* (refer to FIG. 21) by cutting an end face of one long side 55*b* of the base plate 55 such that the inclined face 55*c* is formed and the paper roll-up core shaft 5, 6 are provided at the other end side 56*b* of the thin plate 56 between the bearing side shaft hole 12 and the insertion side shaft hole 13; a guide plate 17 transversely provided between the bearing side support plate 10 and the insertion side support late 11 at the side of such one long side 55*b* so as to be parallel to the axial core; a substantially trapezoidal fish plate 58 shaped in the same manner as the insertion side support plate 11, the fish plate being erected in parallel to the insertion side support plate 11 via a spacer 57 (refer to FIG. 21 and FIG. 23) provided on the insertion side support plate 11 such that the base plate 55 extends narrowly from the insertion side support plate 11; a plate shaped actuating cam 60 whose thickness does not exceed a width of the spacer 57, the cam being turnably provided in an axial direction on a small shaft 59 while the small shaft 59 (refer to FIG. 21 and FIG. 23) axially provided on the insertion side support plate 11 and the fish plate 58 vertically downwardly of the axial core and in parallel to the axial core is defined as a rotary shaft, the cam having formed a shaft hole which transversely opens in an arc recess shape and which is identical to the insertion side shaft hole 13; a guide block 61 whose external shape is housed in an external shape of the fish plate 58, in which when the paper roll-up core shafts 5, 6 are mounted to be inserted into the insertion side shaft hole 13, the handle 21 of the paper roll-up core shafts 5, 6 has a gap, and a turnably engaged arc-shaped recess portion 61*a* opens upwardly, and the fish plate has the substantially same thickness as the handle 21; an incorporating paper thickness recognizing arm portion (paper thickness notifying means) (hereinafter, referred to as an "incorporating arm portion") 65 having an incorporating arc shaped engagement recess portion (hereinafter, referred to as an "incorporating recess portion") 64 which can be maintained in a backlash state while it is transversely engaged with the thin paper roll-up core shaft 5 provided to be turnably mounted in an axial direction on an arm shaft 63 when the arm shaft 63 axially mounted on a pair of plate shaped bearings 62, 62 vertically downwardly of the axial core close to the bearing side support plate 10 and in parallel to the axial core is defined as a rotary shaft; an assembly paper thickness recognizing arm portion (paper thickness notifying means) (hereinafter, simply referred to an "assembling arm portion") 67 having an assembling arc shaped engagement recess portion (hereinafter, simply referred to as an "assembling recess portion") 66 which can be maintained in a backlash state to be transversely engaged with the assembling paper roll-up core shaft 6 provided to be turnably mounted in an axial direction on the arm shaft 63 in line with the incorporating arm portion 65; and a recess shaped bearing 68 with jaw which is turnably mounted in the bearing side shaft hole 12.

At the paper roll-up core shafts 5, 6, as shown in FIG. 23, the thick handle 21 is fixed at the proximal end portions 5*a*, 6*a* of the paper roll-up shafts 5, 6 so as to define the axial core of the paper roll-up core shafts 5, 6 each as a rotary shaft. The handle 21 is formed in a columnar shape. At the columnar handle 21, there are provided: a ring shaped inside spacer 69 integrally formed at the columnar handle 21 around the paper roll-up core shafts 5, 6 each; a cylindrical spacer 70 integrally formed via the inside spacer 69, the spacer 70 having a width when the insertion side support plate 11, planar actuating cam 60, and fish plate 58 are summed up in external diameter turnably engaged with the insertion side shaft hole 13; and a ring shaped outside spacer 71 integrally formed with the cylindrical spacer 70 in the same shape as the inside spacer 69. In FIG. 24, although the columnar handle 21 at the side of the proximal end portion 6*a* of the paper roll-up shaft 6 is omitted, the same columnar handle 21 as the columnar handle 21 is fixed in the paper roll-up core shaft 6 as well. In the circular handle 21 of the paper roll-up core shaft 6 as well, there are provided an inside spacer 69, a cylindrical spacer 70, and an outside spacer 71 which are identical to the above spacers. When the paper roll-up core shafts 5, 6 having their different cylinder diameters are provided between the bearing side shaft hole 12 and the insertion side shaft hole 13, it is unnecessary to change the hole diameter of the insertion side shaft hole 13 according to such different diameters.

In addition, the insertion side support plate 11 and fish plate 58 open in U shape so that their upper center includes the insertion side shaft hole 13. In this manner, at the proximal end portion 6*a*, the paper roll-up core shafts 5, 6 can be upwardly mounted in the insertion side shaft hole 13. As a result, the cylindrical spacer 70 of a spacer portion including the inside spacer 69, cylindrical spacer 70, and outside spacer 71 is turnably engaged in the insertion side shaft hole 11. In addition, the actuating cam 60 is elastically energized in the direction indicated by the arrow G around the small shaft 59 by means of a coil spring 72 at one end fixed on the insertion side support plate 11. Thus, the paper roll-up core shafts 5, 6 mounted in the insertion side shaft hole 13 do not slip off upwardly during paper rolling. Further, the guide block 61 is formed in thickness which is substantially equal to thickness of the columnar handle 21, and the upper portion of the columnar handle 21 is exposed from the top face of the guide block 61. Thus, the columnar handle 21 is manually turned-with one's palm, whereby the paper roll-up core shafts 5, 6 can be turned without applying a force.

Moreover, on the top face of the guide plate 17, there is provided a first cut groove 73 formed in a longitudinal direction with a desired width which can be glued from the inside end face of the shaft core side. In addition, a second cut groove 74 formed in a cut stepped shape is provided on the outside end face. In this manner, the remaining paper 2 after rolled can be easily cut by running a blade of a cutter along the first cut groove 73 or second cut groove 74.

The thin plate 56 is formed in a shape such that portions corresponding to positions at which the incorporating and assembling arm portions 65 and 67 are disposed are cut in a recess shape so as to transversely engage the incorporating and assembling recess portions 64, 66 of the incorporating and assembling arm portions 65, 67 with the provided paper roll-up core shafts 5, 6. In addition, the thin plate 56 is formed in a shape such that the plate is cut in a recess shape at horizontally symmetrical positions as well so as to easily mount the plate on the base plate 55. If the paper roll-up core shafts 5, 6 are provided, the other end side 56*b* of the thin plate 56 is pushed downwardly from the upward direction against the resilient force by means of the paper roll-up core shafts 5, 6. Thus, the paper roll-up core shafts 5, 6 are maintained to be pushed upwardly from the downward direction against the resilient force of the thin plate 56. Therefore, the rolled paper can be prevented from being slackened. If the actuating cam 60 is turned in a direction opposite to that indicated by the arrow G, thereby releasing the proximal end portions 5*a*, 6*a* of the paper roll-up core shafts 5, 6, the paper roll-up core shafts 5, 6 are automatically pushed upwardly by the resilient pushup power caused by the thin plate 56.

The recess shaped bearing 68 with jaw is turnably mounted in the bearing side shaft hole 12 of the bearing side support plate 10 while a jaw portion of the bearing 68 with jaw is oriented inwardly, as shown in FIG. 23 and FIG. 24. A circular shallowly bottomed recess portion 68*a* is formed on the jaw side face of the bearing 68. Further, there is formed a deeply bottomed assembling ring groove 68*b* of an internal diameter which is equal to an external diameter of the circular shallowly bottomed recess portion 68*a* in which the center of the recess portion 68*a* is concentrically defined toward the depth. At the center, there is formed an incorporating columnar portion 68*c* of an external diameter which is equal to an internal diameter of the thin roll-up core shaft 5 exposed at the center of the shallowly bottomed recess portion 68*a*. Thus, when the thin paper-roll-up core shaft 5 is used, the distal end 5*b* of the thin paper roll-up core shaft 5 is inserted into the incorporating columnar portion 68*c*, as shown in FIG. 23. When the assembling paper roll-up core shaft 6 is used, the distal end 6*b* of the incorporating columnar portion 6 is inserted into the assembling ring groove 68*b*, as shown in FIG. 24. In this manner, the above bearing can be provided, thus making it unnecessary to replace bearing engaged in the bearing side shaft hole 12.

In addition, the incorporating recess portion 64 of the incorporating arm portion 65 is formed to have an internal diameter which is equal to or does not exceed an external diameter of the assembling paper roll-up shaft 6. In other words, the internal diameter of the recess portion is defined so that a diameter of a paper cylinder is equal to an external diameter engaged in the cavity portion 7 of the a thick cylindrical block 4 when rolling on the thin paper roll-up core shaft 5 is inhibited after a paper cylinder has been engaged with the incorporating recess portion 64 in an intimate contact state. In this manner, the incorporating arm portion 65 functions as a gauge indicating that the cylinder diameter of paper rolled on the assembling paper roll-up core shaft 6 is rolled in external diameter engaged in the cavity portion 7 of the a thick cylindrical block 4. The assembling recess portion 66 of the assembling arm portion 67 is formed to have an internal diameter which is equal to an external diameter of the a thick cylindrical block 4. In other words, the internal diameter of the recess portion 66 is-defined so that a diameter of a paper cylinder is equal to an external diameter of the a thick cylindrical block 4 having sufficient rigidity when rolling on the assembling paper roll-up core shaft 6 is inhibited after a paper cylinder has been engaged with the assembling recess portion 66 in an intimate contact state. Thus, the assembling arm portion 67 functions as a gauge indicating that the arm portion is rolled on the a thick cylindrical block 4 capable of assembling a rigid solid creation.

Figure 22:
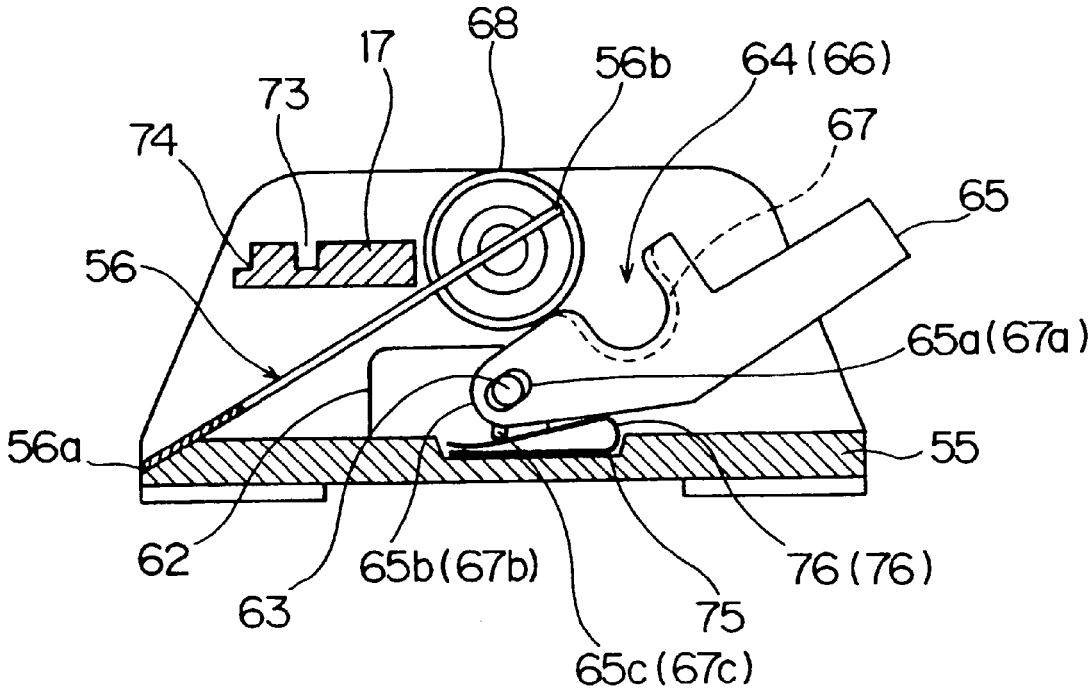
FIG. 22 is a longitudinal cross section taken along the line F—F of the main body illustrated in FIG. 20.

Moreover, at the lower end portion of the incorporating and assembling arm portions 65, 67, as shown in FIG. 22, there are provided elliptical shaft elongated holes 65*a*, 67*a* extending in a direction identical to the longitudinal direction of the incorporating and assembling arms 65, 67. The shaft elongated holes 65*a*, 67*a* are formed in a shape such that the arm shaft 63 can move slidably. Thus, as paper is rolled, a center of the paper roll-up core shaft 56 coincides with that of the recess portions 64, 66. The incorporating and assembling recess portions 64, 66 of the incorporating and assembling arm portions 65, 67 are engaged with the paper roll-up core shafts 5, 6. In this manner, the incorporating and assembling recess portions 64, 66 of the incorporating and assembling arm portions 65, 67 can be easily removed from the paper roll-up core shafts 5, 6 after the paper has been rolled up. In addition, the lower end faces 65*b*, 67*b* of the incorporating and assembling arm portions 65, 67 are formed in a semicircular shape. At the downward positions of the lower end faces 65*b*, 67*b*, which abuts diagonally backwardly of the shaft elongated holes 65*a*, 67*a* (in opposite to the arc shaped engagement recess portions 64, 66), there are provided protrusion portions 65*c*, 67*c* for compressing a plate spring described later. A flatly bottomed cavity 75 is formed on the surface of the base plate 55 sandwiched between both the bearings 62, 62, and plate springs 76, 76 are mounted, respectively, so as to correspond to both of the protrusion portions 65*c*, 67*c*. Then, the plate springs 76, 76 are shaped to be aligned on both short sides of one plate and to be curved at the other side. These plate springs are provided in line with the flatly bottomed cavity 75 while the curved side is oriented to be opposed to the arc shaped engagement recess portions 64, 66. In this manner, as shown in FIG. 22, the protrusion portions 65*c*, 67*c* are positioned forwardly of the arm shaft 63 in a standby state in which the incorporating and assembling arm portions 65, 67 are fallen. Thus, this standby state is maintained by the resilient force of the plate springs 76, 76. As shown in FIG. 25, the protrusion portions 65*c*, 67*c* are positioned backwardly of the arm shaft 63 in a state in which the incorporating and assembling arm portions 65, 67 for engaging the incorporating and assembling recess portions 64, 66 with the paper roll-up core shafts 5, 6 are erected. Accordingly, this erected state is maintained by the resilient force of the plate springs 76, 76. As shown in FIG. 26B, this state is not maintained by the resilient force of the plate springs 76, 76 at positions where the protrusion portions 65*c*, 67*c* are substantially underneath the arm shaft 63. In this case, the standby state or erected state is established. Then, in these actions, the arm shaft 63 moves through the shaft elongated holes 65*a*, 67*a* so that the feeling of kick caused by the plate springs 76, 76 can be obtained.

Now, a method for using the present invention will be described by way of example of fabricating the thin cylindrical block 3.

The cylindrical spacer 70 of the thin paper roll-up core shaft 5 is positioned at the insertion side shaft hole 13 formed by the insertion side support 11 and fish plate 58. In addition, the distal end 5*b* of the thin paper roll-up core shaft 5 is positioned at the columnar portion 68*c* of the bearing 68. The actuating cam 60 is fallen by turning it in a direction opposite to that indicated by the arrow G in FIG. 21. As shown in FIG. 23, the cylindrical spacer 70 is mounted to be inserted into the insertion side shaft hole 13. In addition, the distal end 5*b* of the thin paper roll-up core shaft 5 is inserted into the columnar portion 68*c*, and the thin paper roll-up core shaft 5 is provided between the bearing shaft hole 12 and the insertion side shaft hole 13. At this time, the other end side 56*b* of the thin plate 56 is pressed downwardly by the thin paper roll-up core shaft 5. Next, as shown in FIG. 25, the incorporating arm portion 65 which is in a standby state (refer to FIG. 26A) is turned in the direction indicated by the arrow H in FIG. 25, and the incorporating recess portion 64 of the incorporating arm portion 65 is transversely engaged in the thin paper roll-up core shaft 5. Then, the columnar handle 21 is turned with one's palm so that the slit 18 of the thin paper roll-up core shaft 5 is opposed to the inside end face of the guide plate 17. As shown in FIG. 27, at a distal end portion, foldout handbill 2 cut in a width which is within a length of the slit 18 is placed on the guide plate 17. At a distal end side, the handbill 2 is inserted into the slit 18 so that the distal end side is pushed to be turned around the round bar 19 along the slit formed in the longitudinal cross section arc shape, the slit being formed in the thin paper roll-up core shaft 5.

Subsequently; the columnar handle 21 is turned with one's palm in the frontal direction shown in FIG. 23 (in the direction indicated by the arrow H shown in FIG. 25), thereby rolling the handbill 2. If the thus rolled paper cylinder fully inflates at the incorporating recess portion 64, the paper cylinder rolled on the thin paper roll-up core shaft 5 is engaged with the incorporating recess portion 64 in an intimate contact state. Then, rolling on the thin paper roll-up core shaft 5 is inhibited. Thus, the handbill 2 cannot be rolled by a gentle manual turn. In this manner, it is possible to recognize that the cylinder diameter of paper rolled on the thin paper roll-up core shaft 5 is rolled on the external diameter engaged in the cavity portion 7 of the thick cylindrical block 4.

Then, the side portion of the thin paper roll-up core shaft 5 of the handbill 2 left on the guide plate 17 is glued toward the widthwise direction. Further, this side portion is cut by running the blade of the cutter in the cut groove 73 formed on the guide plate 17, and adhered onto a paper cylinder after gluing has been rolled.

Then, if the actuating cam 60 is turned in a direction opposite to that indicated by the arrow G, thereby releasing the thin paper roll-up core shaft 5, the thin paper core shaft 5 is pushed upwardly by the resilient force of the thin plate 56 so that the thin paper roll-up core shaft 5 can be easily removed from the main body 54.

In the present embodiment as well, since the thin cylindrical block 3 having an external diameter engaged in the cavity portion 7 of the thick cylindrical block 4 can be fabricated easily, the same advantageous effect as the above first embodiment can be provided.

In the foregoing embodiments each, the following description has been given. That is, in the case where paper thickness notifying means is a paper thickness display portion 16 indicating paper thickness dimensions of a paper cylinder rolled on the external diameter engaged in the cavity portion 7 of the a thick cylindrical block 4, such means is provided as a paper thickness recognizing arm 65. This paper thickness recognizing arm 65 notifies that the cylinder diameter of paper rolled on the thin paper roll-up core shaft 5 is rolled on the external diameter engaged in the cavity portion 7 of the a thick cylindrical block 4. This is accomplished if rolling on the thin paper roll-up core shaft 5 is inhibited when the paper cylinder rolled on the thin paper roll-up core shaft 5 is engaged with the arc shaped engagement recess portion 64 in an intimate contact state. According to the present invention, without being limited thereto, a micro-switch or a micro-sensor may be incorporated in the arc shaped engagement recess portion 64 of the paper thickness recognizing arm portion 65. In addition a switch is turned ON when the cylinder diameter of paper rolled on the thin paper roll-up core shaft 5 is rolled on the external diameter engaged in the cavity portion 7 of the incorporating thick cylindrical block 4, whereby the fact may be notified by the LED, buzzer, or voice and the like. A clutch may be incorporated in the handle 21. The handle 21 may be designed to be idled relevant to the paper roll-up core shafts 5, 6 when rolling on the thin paper roll-up core shaft 5 is inhibited after the paper cylinder rolled on the thin paper roll-up core shaft 5 has been engaged with the arc shaped engagement recess portion 64 in an intimate contact state.

EXAMPLES

Example 1

The block fabricating apparatus in the first embodiment was provided. There were used: a thin paper roll-up core shaft 5 of 6 mm in external diameter forming a slit 18 capable of longitudinally inserting paper 2 of size A3; and a thick paper roll-up core shaft 6 of 8 mm in external diameter. The internal diameter of the thin paper roll-up core shaft 5 was defined to be 5 mm, and the external diameter of a round bar 9 internally provided therein was defined to be 3 mm. The internal diameter of the thick paper roll-up core shaft 6 was defined to be 7 mm, and the external diameter of a round bar 9 internally provided therein was defined to be 4 mm. In addition, a number of fold handbills were used for paper 2.

The paper 2 was rolled on the thin paper roll-up core shaft 5, and a plurality of thin cylindrical blocks 3 within the range of external diameter of 7 mm to 8 mm were fabricated. In addition, the paper 2 was rolled on the thick paper roll-up core shaft 6, and a plurality of thick cylindrical blocks 4 of 10 mm in external diameter was fabricated.

As shown in FIG. 8, when the thin cylindrical block 3 was mounted to be inserted into a cavity portion 7 of the thick cylindrical block 4, the thin cylindrical block 3 was engagingly fitted to the thick cylindrical block 4 in an intimate contact state. In addition, when the thin cylindrical block 3 was mounted to be inserted into the incorporating hole 8 of 7 mm to 8 mm drilled on the side face of the thick cylindrical block 4, the thin cylindrical block 3 was engagingly fitted to the thick cylindrical block 4 in an intimate contact state.

An end face of the thin cylindrical block 3 is ground in a pot shape, whereby the end face may be mounted to be inserted into the cavity portion 7 of the thick cylindrical block 4.

Example 2

The block fabricating apparatus in the sixth embodiment was provided. The thin paper roll-up core shaft 5 and thick paper roll-on core shaft 6 of Example 1 described previously were used. The internal diameter of the incorporating recess portion 64 of the incorporating arm portion 65 was defined to be 7.3 mm, and the internal diameter of the assembling recess portion 66 of the assembling arm portion 67 was defined to be 9.3 mm.

In the present Example as well, the thin cylindrical block 3 and thick cylindrical block 4 having the advantageous effect similar to that of Example 1 described previously were successfully fabricated.

According to the present invention, blocks for assembly of a solid creation capable of assembling a solid creation can be fabricated by using daily delivered newspaper or foldout handbill, used package paper or copying paper and the like. Thus, there is no need to purchase a commercially available assembly toy. Therefore, the present invention can be easily accepted at an educational site such as preschool or elementary school, thereby making it possible to lead to recycling of unnecessary paper and contribute to energy saving.

In addition, blocks for assembly of a solid creation which realize a solid creation freely created by children can be fabricated. Thus, a process from fabrication of the blocks to assembly of a solid creation can be enjoyed with pleasure under a cooperation of parents and children. Advantageous effect that conversational opportunities between the parents and children increase can be attained.

Therefore, the industrial applicability of the present invention is considered to be very high.

FIG. 1
12 BEARING SIDE SHAFT HOLE
14 COMPRESSION ROLLER
27 BEARING SIDE ARM
10 BEARING SIDE SUPPORT PLATE
28 BEARING SIDE ARM
16 PAPER THICKNESS DISPLAY PORTION
31 SCALE PLATE
32 PAPER THICKNESS DIMENSION SCALE
33 INDICATOR
29 COMPRESSION SPRING
1 BLOCK FABRICATING APPARATUS
9 FRAME BODY
17 GUIDE PLATE
2 PAPER
28 SLIT
15 COMPRESSION ROLLER
6 ASSEMBLING PAPER ROLL-UP CORE SHAFT
13 INSERTION SIDE SHAFT HOLE
22 GRIP
21 HANDLE
11 INSERTION SIDE SUPPORT PLATE
26 INSERTION SIDE ARM
FIG. 2
18 SLIT
19 ROUND BAR
21 HANDLE
22 GRIP
FIG. 3
**5*b*** DISTAL END
5 INCORPORATING PAPER ROLL-UP CORE SHAFT
20 FIXING PIN
**5*a*** PROXIMAL END PORTION
FIG. 5
24 BEARING
19 ROUND BAR
25 CIRCULAR GROOVE
FIG. 8
7 CAVITY PORTION
4 THICK CYLINDRICAL BLOCK
3 THIN CYLINDRICAL BLOCK
FIG. 9

8 INCORPORATING HOLE
FIG. 16
40 SOLID CREATION
FIG. 18
45 PAPER CYLINDER
FIG. 19A
47 ROTARY ENCODER
51 DISPLAY PORTION
46 DISTANCE MEASURING INSTRUMENT
WIRE
PULLEY
FIG. 20
68 BEARING
67 ASSEMBLING ARM PORTION
66 ASSEMBLING RECESS PORTION
64 INCORPORATING RECESS PORTION
65 INCORPORATING ARM PORTION
62 BEARING
54 MAIN BODY
56 THIN PLATE
55 BASE PLATE
73 CUT GROOVE
60 ACTUATING CAM
58 FISH PLATE
61 GUIDE BLOCK
74 CUT GROOVE
63 ARM SHAFT
FIG. 22
65*a* (67*a*) SHAFT ELONGATED HOLE
65*b* (67*b*) LOWER END FACE
65*c* (67*c*) PROTRUSION PORTION
75 CAVITY
76 (76) PLATE SPRING

What is claimed is:

1. A solid creation block fabricating apparatus for fabricating two types of blocks in a block set for assembling a solid creation by mounting thin cylindrical block into a cavity portion of a thick cylindrical block or into a hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

a thin cylindrical paper roll-up core shaft for rolling paper by rotatably bridging the paper in shaft holes, thereby fabricating the thin cylindrical block; and a thick cylindrical paper roll-up core shaft of an external diameter which is greater than an external diameter of the thin paper roll-up core for rolling paper by rotatably bridging the paper in the shaft holes, thereby fabricating the thick cylindrical block.

2. A solid creation block fabricating apparatus for fabricating two types of blocks in a block set for assembling a solid creation by mounting thin cylindrical block into a cavity portion of a thick cylindrical block or into a hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

a thin cylindrical paper roll-up core shaft for rolling paper by rotatably bridging the paper in the shaft holes, thereby fabricating the thin cylindrical block;

a thick cylindrical paper roll-up core shaft of an external diameter which is greater than an external diameter of the incorporating paper roll-up core for rolling paper by rotatably bridging the paper in the shaft holes, thereby fabricating the thick cylindrical block; and paper thickness notifying apparatus for notifying that a cylindrical diameter of paper rolled on the thin paper roll-up core shaft has been rolled to an external diameter which engages in the cavity portion of the thick cylindrical block.

3. A solid creation block fabricating apparatus for fabricating two types of blocks in a block set for assembling a solid creation by mounting a thin cylindrical block into a cavity portion of a thick cylindrical block or into a hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected in opposite to each other and having shaft holes opened at relative positions;

a thin cylindrical paper roll-up core shaft for rolling paper by rotatably bridging the paper in shaft holes, thereby fabricating the thin cylindrical block;

a thick cylindrical paper roll-up core shaft of an external diameter which is greater than an external diameter of the thin paper roll-up core for rolling paper by rotatably bridging the paper in the shaft holes, thereby fabricating the thick cylindrical block; and paper thickness notifying apparatus for notifying that a cylinder diameter of paper rolled on the thin cylindrical paper roll-up core shaft has been rolled to an external diameter which engages in the cavity portion of the thick cylindrical block, wherein, on said each paper roll-up core shafts, a slit for inserting a distal end side of the paper running up to a distal end of the paper roll-up core shaft is provided in parallel to an axial core of the paper roll-up core shaft;

wherein the slit is formed in a longitudinal cross section arc shape inscribed in the paper roll-up core shaft toward the inside of the paper roll-up core shaft from a side face of the paper roll-up core shaft; and a guide plate for guiding a distal end side of the paper to a position along the slit of the paper roll-up core shaft when the paper roll-up core shaft is provided in the shaft hole is transversely provided on the support plate.

4. A solid creation block fabricating apparatus according to claim 5, wherein the paper thickness notifying apparatus comprises a paper thickness display portion which indicates paper thickness dimensions of a paper cylinder rolled to an external diameter which engages in the cavity portion of the thick cylindrical block.

5. A solid creation block fabricating apparatus according to claim 1, wherein the paper thickness notifying apparatus is a paper thickness recognizing arm having an arc shaped engagement recess portion maintained in a backlash state by being transversely engaged with paper roll-up core shaft rotatably provided in a shaft hole;

wherein the paper cylinder rolled on the paper roll-up core shaft is engaged with the arc shaped engagement recess portion in an intimate contact state so that rolling on the paper roll-up core shaft is inhibited, and wherein the cylinder diameter of paper rolled on the roll-up core shaft is rolled to an external diameter which engages in the cavity portion of the thick cylindrical block.

6. A solid creation block fabricating apparatus for fabricating two types of blocks in a block set for assembling a solid creation by mounting a thin cylindrical block into a cavity portion of a thick cylindrical block or into a hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

a thin cylindrical paper roll-up core shaft for rolling paper by rotatably bridging the paper in the shaft holes, thereby fabricating the thin cylindrical block;

a thick cylindrical paper roll-up core shaft of an external diameter which is greater than an external diameter of the thin cylindrical paper roll-up core for rolling paper by rotatably bridging the paper in the shaft holes, thereby fabricating the thick cylindrical block;

a set of turnable compression rollers abutted against at least one paper roll-up core shaft provided by biasing the rollers from both sides; and a paper thickness display portion for indicating paper thickness dimensions rolled to an external diameter which engages in the cavity portion of the thick cylindrical block together with the compression roller spread as paper is rolled on the thick cylindrical block.

7. A solid creation assembling block fabricating apparatus for fabricating two types of blocks in a block set for assembling a solid creation by mounting a thin cylindrical block into a cavity portion of a thick cylindrical block or into a hole opening on a side face of the thick cylindrical block by using two types of blocks that are the thin cylindrical block of a desired length having paper cylindrically rolled and the thick cylindrical block of a desired length having cylindrically rolled paper with an internal diameter capable of mounting the thin cylindrical block, the apparatus comprising:

a set of support plates erected opposite to each other and having shaft holes opened at relative positions;

a thin cylinder paper roll-up core shaft for rolling paper by rotatably bridging the paper in shaft holes, thereby fabricating the thin cylindrical block;

a thick cylinder paper roll-up core shaft of an external diameter which is greater than an external diameter of the thin paper roll-up core for rolling paper by rotatably bridging the paper in the shaft holes, thereby fabricating the thick cylindrical block;

a set of turnable compression rollers abutted against at least one paper roll-up core shaft provided in the shaft hole by biasing the rollers from both sides; and a paper thickness display portion for indicating paper thickness dimensions rolled on the external diameter engaged in the cavity portion of the thick cylindrical block together with the compression roller spread as paper is rolled on the thick cylindrical block, wherein, on said each paper roll-up core shaft, a slit for inserting a distal end side of the paper running up to a distal end of the paper roll-up core shaft is provided in parallel to the axial core of the paper roll-up core shaft;

the slit is formed in a longitudinally cross section arc shape inscribed in the paper roll-up core shaft toward the paper roll-up core shaft from the side face of the paper roll-up core shaft, and a guide plate for guiding a distal end side of the paper to a position along the slit of the paper roll-up core shaft when the paper roll-up core shaft is provided in the shaft hole is transversely provided on the support plate.

* * * * *

UNITED STATES PATENT AND TRADEMARK OFFICE

CERTIFICATE OF CORRECTION

PATENT NO. : 7,077,357 B2
APPLICATION NO. : 11/006712
DATED : July 18, 2006
INVENTOR(S) : Yoshihiro Taki It is certified that error appears in the above-identified patent and that said Letters Patent is hereby corrected as shown below:

Column 24
Line 55, delete "5" and substitute therefore -- 1--

Signed and Sealed this

Twenty-first Day of November, 2006

JON W. DUDAS
*Director of the United States Patent and Trademark Office*